US008758530B2

(12) United States Patent
Rioja et al.

(10) Patent No.: US 8,758,530 B2
(45) Date of Patent: Jun. 24, 2014

(54) METHODS OF AGING ALUMINUM ALLOYS TO ACHIEVE IMPROVED BALLISTICS PERFORMANCE

(75) Inventors: Roberto J. Rioja, Murrysville, PA (US); Dirk C. Mooy, Bettendorf, IA (US); Jiantao T. Liu, Murrysville, PA (US); Francine S. Bovard, Monroeville, PA (US)

(73) Assignee: Alcoa Inc., Pittsburgh, PA (US)

( * ) Notice: Subject to any disclaimer, the term of this patent is extended or adjusted under 35 U.S.C. 154(b) by 570 days.

(21) Appl. No.: 12/875,933

(22) Filed: Sep. 3, 2010

(65) Prior Publication Data

US 2011/0056597 A1 Mar. 10, 2011

Related U.S. Application Data

(60) Provisional application No. 61/239,842, filed on Sep. 4, 2009.

(51) Int. Cl.
*C22F 1/04* (2006.01)

(52) U.S. Cl.
USPC ..... 148/698; 148/700; 148/701

(58) Field of Classification Search
USPC ..... 148/698, 700, 701
See application file for complete search history.

(56) References Cited

U.S. PATENT DOCUMENTS

| | | | | |
|---|---|---|---|---|
| 3,962,976 | A | 6/1976 | Kelsey | 109/82 |
| 4,090,011 | A | 5/1978 | Barkman et al. | 428/653 |
| 4,406,717 | A | 9/1983 | Vernam et al. | 148/440 |
| 4,469,537 | A | 9/1984 | Ashton et al. | 148/440 |
| 4,610,733 | A | 9/1986 | Sanders, Jr. et al. | 148/695 |
| 4,848,647 | A | 7/1989 | Gentry et al. | 228/262.5 |
| 5,455,003 | A | 10/1995 | Pickens et al. | 420/529 |
| 5,512,112 | A | 4/1996 | Cassada, III | 148/550 |
| 6,698,690 | B2 | 3/2004 | Novak et al. | 244/121 |
| 6,972,110 | B2 | 12/2005 | Chakrabarti et al. | 420/532 |
| 7,536,072 | B2 | 5/2009 | Craig et al. | 385/107 |
| 7,905,540 | B2 | 3/2011 | Kiley et al. | 296/193.04 |
| 8,152,943 | B2 | 4/2012 | ten Cate et al. | 148/559 |
| 2006/0191609 | A1 | 8/2006 | Dangerfield et al. | 148/552 |
| 2011/0017055 | A1 | 1/2011 | Mooy et al. | 89/36.02 |

FOREIGN PATENT DOCUMENTS

| | | |
|---|---|---|
| EP | 0250656 | 1/1988 |
| JP | 11-106858 | 4/1999 |
| WO | WO 2007/097817 | 8/2007 |

OTHER PUBLICATIONS

A. Fee, Selection and Industrial Applications of Hardness Tests, "Mechanical Testing and Evaluation", vol. 8, ASM International, ASM Handbook, 2000. p. 260-277.*

Properties of Wrought Aluminum and Aluminum Alloys, "Properties and Selection: Nonferrous Alloys and Speical-Purpose Materials", vol. 2, ASM Handbook, ASM International, 1990, p. 62-122.*

(Continued)

*Primary Examiner* — Roy King
*Assistant Examiner* — Janelle Morillo
(74) *Attorney, Agent, or Firm* — Greenberg Traurig, LLP

(57) ABSTRACT

Aluminum alloy products having improved ballistics performance are disclosed. The aluminum alloy products may be underaged. In one embodiment, the underaged aluminum alloy products realize an FSP resistance that it is better than that of a peak strength aged version of the aluminum alloy product. In one embodiment, ballistics performance criteria is selected and the aluminum alloy product is underaged an amount sufficient to achieve a ballistics performance that is at least as good as the ballistics performance criteria.

16 Claims, 23 Drawing Sheets

(56) References Cited

OTHER PUBLICATIONS

Publication No. AMS 4206A, "Aluminum Alloy, Plate (7055-T7751) 8.0Zn—2.3Cu—2.0Mg—0.16Zr Solution Heat Treated, Stress Relieved, and Overaged," pp. 1-5, SAEAerospace, Aug. 2006.
Publication No. AMS 4329A, "Aluminum Alloy, Plate (7085-T7651) 7.5Zn—1.6Cu—1.5Mg—0.12Zr Solution Heat Treated, Stress-Relieved, and Overaged," SAE Aerospace, an SAE International Group, pp. 1-6, Jul. 2003, revised May 2006.
Publication No. ANSI H35.1, "American National Standard Alloy and Temper Designation Systems for Aluminum," The Aluminum Association Inc., 2009.
Publication No. DRSTA-P-702-108, "Product Assurance Pamphlet: Inspection of Aluminum Alloy Armor for Tank-Automotive Vehicles," U.S. Army Tank-Automotive Command, Feb. 1982.
Publication No. MIL-A-22771D, "Military Specification Aluminum Alloy Forgings, Heat Treated," 1999 and 2007.
Publication No. MIL-DTL-45225F (MR), "Detail Specification Aluminum Alloy Armor, Forged," U.S. Army. Research Laboratory, Aberdeen Proving Ground, MD, Apr. 22, 1998.
Publication No. MIL-DTL-46027K(MR), "Armor Plate, Aluminum Alloy, Weldable 5083, 5456, & 5059," pp. 1-28, U.S. Army Research Laboratory, Jul. 2007.
Publication No. MIL-A-46063G, "Armor Plate, Aluminum Alloy, 7039," pp. 1-26, U.S. Army Materials Technology Laboratory, Dec. 1992.
Publication No. MIL-DTL-46063H, Amendment 1, "Detail Specification Armor Plate, Aluminum Alloy, 7039," U.S. Army Research Laboratory, Aberdeen Proving Ground, MD, Aug. 26, 1999.
Publication No. MIL-DTL-46192C(MR), Amendment 1, "Aluminum Alloy Armor Rolled Plate (1/2 to 4 Inches Thick), Weldable (Alloy 2519)," pp. 1-21 and Appendix A, U.S. Army Research Laboratory, Feb. 2000.
Publication No. MIL-STD-662F, "$V_{50}$ Ballistic Test for Armor," Department of Defense Test Method Standard, Dec. 1997, pp. 1-17, downloaded from the Internet at http://ww.everyspec.com on Aug. 26, 2010.
Registration Record Series Teal Sheets, "International Alloy Designations and Chemical Composition Limits for Wrought Aluminum and Wrought Aluminum Alloys," pp. 1-27, The Aluminum Association Inc., Feb. 2009.
Cheeseman, B., et al., "Ballistic Evaluation of Aluminum 2139-T8," *24th International Ballistics Symposium*, New Orleans, LA, Sep. 22-26, 2008.
Chin, E. S. C., "Army Focused Research Team on Functionally Graded Armor Composites," *Materials Science and Engineering A259*, pp. 155-161, 1999.
Chinella, J. F., "High-Strength Al—Cu—Li and Al—Zn Alloys: Mechanical Properties with Statistical Analysis of Ballistic Performance," Pub. No. ARL-TR-3185, pp. 1-61, U.S. Army Research Laboratory, Apr. 2004.
Gooch, W. A., et al., "Ballistic Testing of Commercial Aluminum Alloys and Alternate Processing Techniques to Increase the Availability of Aluminum Armor," 23rd International Symposium on Ballistics, Tarragona, Spain, Apr. 16-22, 2007.
Gooch, W. A., et al., "Analysis of Threat Projectiles for Protection of Light Tactical Vehicles," Report No. ARL-RP-89, Army Research Laboratory, 2004.
Lee, C. G., et al., "Dynamic Deformation Characteristics of Aluminum-Lithium Alloys," *Light Weight Alloys for Aerospace Applications IV*, TMS (1997).
Leech, P. W., Observations of Adiabatic Shear Band Formation in 7039 Aluminum Alloy, *Metallurgical. Transactions A*., vol. 16A, pp. 1900-1903, 1985.
Meyers, M. A., *Dynamic Behavior of Materials*, John Wiley & Sons Inc., New York, 1994, pp. 604.
Meyers, M. A., et al., "Effect of Metallurgical parameters on Shear Band Formation in Low-Carbon (~0.20 Wt Pct) Steels," *Metallurgical Transactions A*, 21A:3153-3164 (Dec. 1990).
Mukhopadhyay, A. K., et al., "Development of Microstructure and Mechanical Properties in a 7017 Base Aluminium Armour Alloy," *Proceedings of the International Conference on Aluminium, INCAL '98*, vol. 2, pp. 73-79, The Aluminium Association of India (Feb. 1998).
Owolabi, G. M., et al., "Dynamic Shear Band Formation in Aluminum 6061-T6 and Aluminum 6061-T6/$Al_2O_3$ Compsites," *Materials Science and Engineering A*, 457:114-119 (2007).
Rinnovatore, J. V., et al., "Correlation Determinations Between Stress Corrosion Characteristics of Wrought 7039 Aluminum Armor and Other Alloy Characteristics—Ballistic Performance, Yield Strength, and Electrical Conductivity," pp. 1-26, Frankford Arsenal Technical Report FA-TR-75026, Apr. 1975.
Stock, T. A. C., et al., "Penetration of Aluminum Alloys by Projectiles," *Metallurgical Transactions*, vol. 1, pp. 219-224, (Jan. 1970).
Timothy, S. P., "The Structure of Adiabatic Shear Bands in Metals: a Critical Review," *Acta Metal*., 35(2): 301-306 (1987).
Vruggink, J. E., "Study of Improved Aluminum Materials for Vehicular Armor," pp. 1-172, Frankford Arsenal Technical Report No. FA-54-76073, Defense Technical Information Center, Accession No. ADA039488, Apr. 1977.
Yang, Y., et al., "Numerical and Experimental Studies of Self-Organization of Shear Bands in 7075 Aluminium Alloy," *Materials Science and Engineering A*, 496:291-302 (2008).
International Search Report and Written Opinion, dated May 9, 2011, from the corresponding International Application No. PCT/US2010/047866.
"Aluminum, vol. II. Design and Application," pp. 92-97, *American Society for Metals*, Ed. Kent R. Van Horn, 1967.

* cited by examiner

FIG. 7a
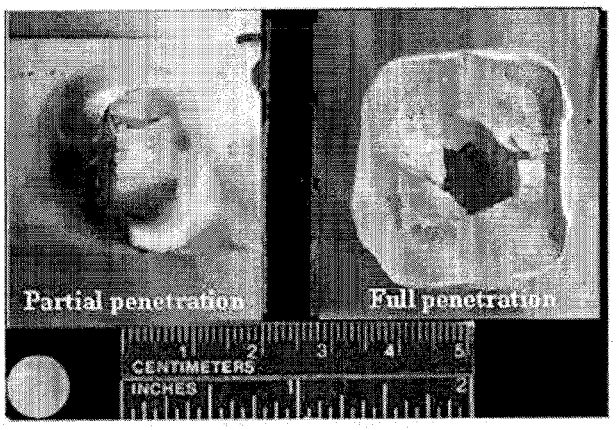
FIG. 7b
FIG. 7c
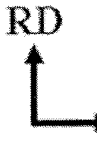
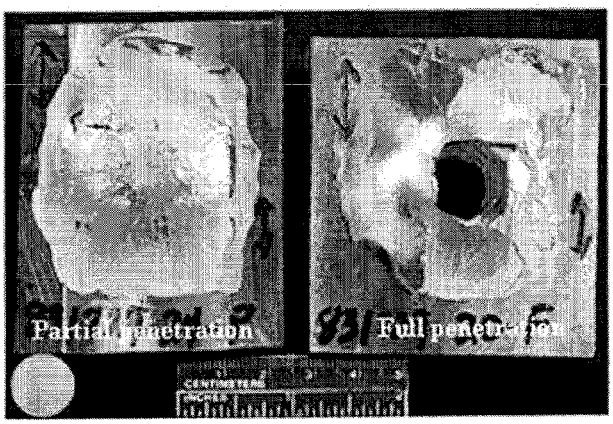
FIG. 7d
FIG. 7e
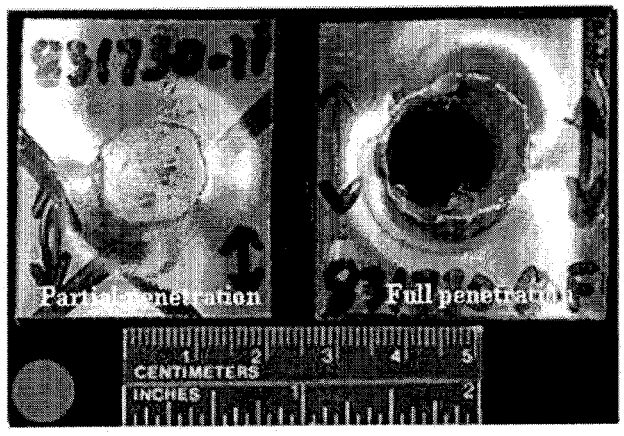
FIG. 7f FIG. 17b
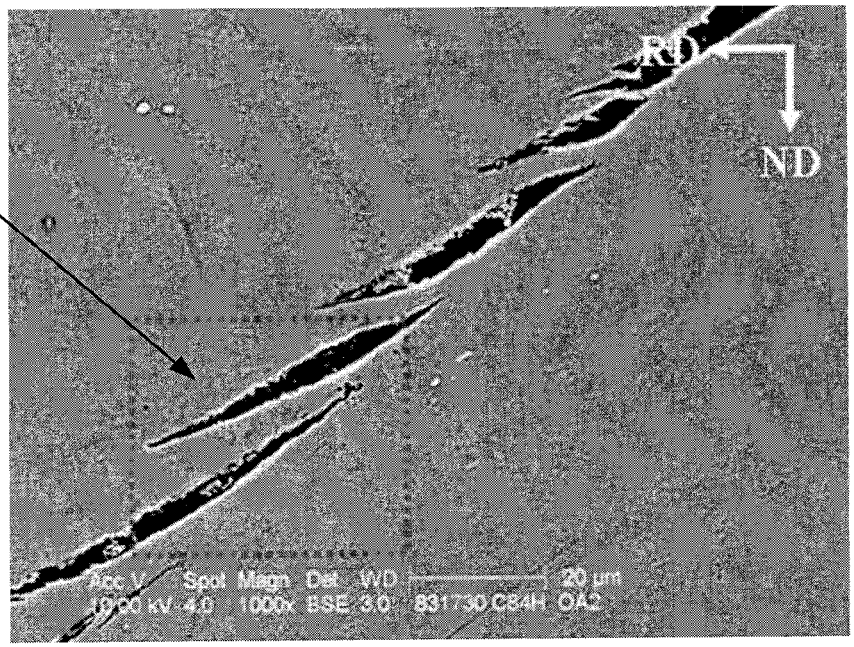
FIG. 17a
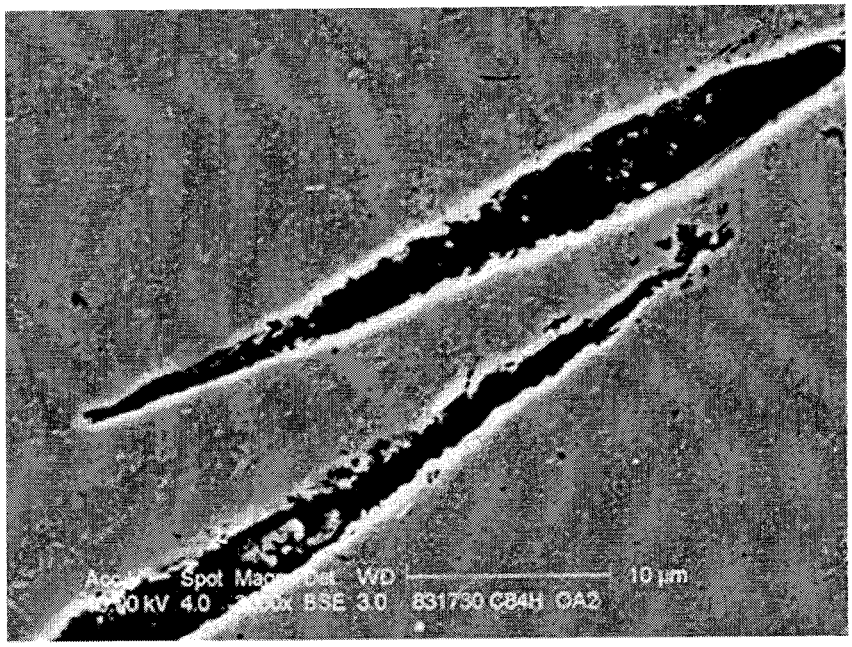
FIG. 17b

METHODS OF AGING ALUMINUM ALLOYS TO ACHIEVE IMPROVED BALLISTICS PERFORMANCE

CROSS-REFERENCE TO RELATED APPLICATION

This patent application claims priority to U.S. Provisional Patent Application No. 61/239,842, entitled "METHODS OF AGING ALUMINUM ALLOYS TO ACHIEVE IMPROVED BALLISTICS PERFORMANCE," filed Sep. 4, 2009, which is incorporated herein by reference in its entirety. This patent application is also related to International Patent Application No. PCT/US2010/047866, entitled "METHODS OF AGING ALUMINUM ALLOYS TO ACHIEVE IMPROVED BALLISTICS PERFORMANCE," filed Sep. 3, 2010, which is incorporated herein by reference in its entirety.

BACKGROUND

Aluminum alloys are generally lightweight, inexpensive and relatively strong. However, the use of aluminum alloys in military applications has been limited due to, for example, unsuitable ballistics performance.

SUMMARY OF THE DISCLOSURE

Broadly, the present disclosure relates to improved methods of aging aluminum alloys to achieve an improved combination of properties. These new methods may produce aluminum alloy products having improved ballistics performance. In one embodiment, the new methods may produce aluminum alloy products that realize improved fragment simulation projectile (FSP) resistance. In one embodiment, the new methods may produce aluminum alloy products that realize an improved combination of FSP resistance and armor piercing (AP) resistance.

In one embodiment, and with reference now to FIG. 1, a method includes the steps of selecting ballistics performance criteria for an aluminum alloy product (100) and producing the aluminum alloy product (200) having a ballistics performance. The ballistics performance is at least as good as the ballistics performance criteria.

The producing step (200) comprises preparing the aluminum alloy product for aging (220), and aging the aluminum alloy product (240), where the aging step comprises underaging (250) the aluminum alloy product an amount sufficient to achieve the ballistics performance. It has been found that underaging (250) of aluminum alloy products may substantially improve the ballistics performance of such aluminum alloy products. In some embodiments, the ballistics performance is better than that of a peak strength aged version of the aluminum alloy product. After the aging step (240), the product may be subjected to optional treatments (255), described below, and provided to the customer (300).

The selecting ballistics performance criteria step (100) may include selecting at least one of FSP resistance criteria and AP resistance criteria. In one embodiment, the selected ballistics performance criteria is FSP resistance criteria. Underaging the aluminum alloy products may facilitate improved FSP resistance. That is, FSP resistance may be a function of the amount of aging of the aluminum alloy product.

As known to those skilled in the art, underaging and the like means that the aluminum alloy product is aged at a temperature and/or for a duration that is less than that required to achieve peak strength. Peak strength and the like means the highest strength achieved by a specific aluminum alloy product as determined via aging curves. Different product forms (e.g., extrusions, rolled products, forgings), or similar product forms of different dimensions, may have a different peak strength, and thus each product form and/or similar product forms having different dimensions may require their own aging curve to determine the peak strength of the aluminum alloy product. The definition of aging, in general, is described below.

Relative to FSP resistance, aging curves may be used for various particular aluminum alloy product forms. Those aging curves may be used to underage those aluminum alloy products, and the FSP resistance of those underaged aluminum alloy products may be determined. The determined FSP resistance may be correlated to the amount of underaging for the aluminum alloy product forms. Consequently, FSP resistance criteria may be selected in advance, and subsequent aluminum alloy products of that product form may be underaged a predetermined amount to achieve the selected FSP resistance criteria based on the correlation.

As noted, the aluminum alloy product may be underaged an amount sufficient to achieve the selected FSP resistance criteria. For example, the aluminum alloy product may be underaged a predetermined amount to achieved the selected FSP resistance criteria (e.g., underage the aluminum alloy product by at least about 3% to achieve a targeted V50 FSP performance). In one embodiment, the aluminum alloy product is underaged by at least 1% relative to peak strength to achieve the selected FSP resistance criteria. For example, if the peak strength of the aluminum alloy product is about 50 ksi, a 1% underaged aluminum alloy product would be underaged and have a strength of not greater than about 49.5 ksi. In other embodiments, the aluminum alloy product is underaged by at least about 2%, or at least about 3%, or at least about 4%, or at least about 5%, or at least about 6%, or at least about 7%, or at least about 8%, or at least about 9%, or at least about 10%, or at least about 11%, or least about 12%, or at least about 13%, or at least about 14%, or at least about 15%, or at least about 16%, or at least about 17%, or at least about 18%, or at least about 19%, or at least about 20%, or at least about 21%, or least about 22%, or at least about 23%, or at least about 24%, or at least about 25%, or more, relative to peak strength to achieve the selected FSP resistance criteria.

By underaging, the aluminum alloy products may realize improved FSP resistance relative to a peak strength aged version of the aluminum alloy product. The FSP resistance is at least as good as the selected FSP resistance criteria. In one embodiment, the aluminum alloy products realize an FSP resistance that it at least about 1% better than that of the peak strength aged version of the aluminum alloy product. In other embodiments, the aluminum alloy products realize an FSP resistance that it at least about 2% better, or at least about 3% better, or at least about 4% better, or at least about 5% better, or at least about 6% better, or at least about 7% better, or at least about 8% better, or at least about 9% better, or at least about 10% better, or at least about 11% better, or at least about 12% better, or at least about 13% better, or at least about 14% better, or at least about 15% better, or more, than that of a peak strength aged version of the aluminum alloy product.

In one embodiment, the selected ballistics performance criteria relates to the V50 performance of the aluminum alloy product at a given areal density. V50 is a measure of ballistics resistance of a material. A V50 value represents the velocity at which there is a 50% probability that a projectile (e.g., a FSP or an AP projectile) will completely penetrate the plate for a given areal density. V50 FSP resistance and AP resistance testing may be conducted in accordance with MIL-STD-662F (1997). In one embodiment, the FSP resistance criteria comprises a minimum V50 performance level, and the minimum V50 performance level is at least about 1% better than the minimum V50 performance level of the peak strength aged version of the aluminum alloy product. In other embodiments, the minimum V50 performance level is at least about 2% better, or at least about 3% better, or at least about 4% better, or at least about 5% better, or at least about 6% better, or at least about 7% better, or at least about 8% better, or at least about 9% better, or at least about 10% better, or at least about 11% better, or at least about 12% better, or at least about 13% better, or at least about 14% better, or at least about 15% better, or more, than that of a peak strength aged version of the aluminum alloy product at a given areal density.

In one embodiment, an underaged aluminum alloy product realizes a V50 FSP resistance that is at least about 1% better than that of a peak strength aged version of the aluminum alloy product at a given areal density. In other embodiments, an underaged aluminum alloy product realizes a V50 FSP resistance that is at least about 2% better, or at least about 3% better, or at least about 4% better, or at least about 5% better, or at least about 6% better, or at least about 7% better, or at least about 8% better, or at least about 9% better, or at least about 10% better, or at least about 11% better, or at least about 12% better, or at least about 13% better, or at least about 14% better, or at least about 15% better, or more, than that of a peak strength aged version of the aluminum alloy product at a given areal density.

A peak strength aged version of the aluminum alloy product is a product that has a similar composition and processing history, is of similar product form (rolled, extruded, forged), and is of similar and comparable dimensions as the underaged product, except that the peak strength aged version of the product is peak aged, whereas the underaged product is underaged.

In one embodiment, the aluminum alloy product may be underaged to achieve a targeted spall performance. Generally, there are two spall modes of failure relative to FSP:

Mode 1: Spall—penetration with detachment.

Mode 2: Spall—prior to penetration.

Of these, Mode 1 is generally preferred. By underaging the aluminum alloy product, FSP resistance relative to spall can be tailored.

Ballistics performance criteria and ballistics performance also includes resistance to armor piecing (AP) projectiles. In some instances, underaging of the aluminum alloy product may result in decreased AP resistance. Thus, in some embodiments, the selecting step (100) comprises selecting one or both of FSP resistance criteria and AP resistance criteria. In turn, the underaging amount may be selected so as to achieve a predetermined balance between FSP resistance and AP resistance. In one embodiment, the aluminum alloy product is underaged an amount sufficient to achieve a minimum FSP resistance criteria while simultaneously achieving a minimum AP resistance criteria. In turn, the aluminum alloy products may realize FSP resistance and AP resistance that at is at least as good as the selected minimum FSP resistance criteria and selected minimum AP resistance criteria. Thus, aluminum alloy products having tailored FSP resistance and AP resistance properties may be produced. In one embodiment, the FSP resistance of the underaged aluminum alloy product is at least 1% better than that of the peak strength aged version of the aluminum alloy product, and while the AP resistance is at least as good as that of the peak strength aged version of the aluminum alloy product. In one embodiment, the FSP resistance of the underaged aluminum alloy product is at least 1% better than that of the peak strength aged version of the aluminum alloy product, and while the AP resistance is at least as good as that of the peak strength aged version of the aluminum alloy product. In other embodiments, the AP resistance is less than that of the peak strength aged version of the aluminum alloy product. In one embodiment, the AP resistance is decreases at a rate slower than the rate that the FSP resistance increases. In one embodiment, the AP resistance decreases (relative to peak strength) by not greater than about 90% of the increase in FSP resistance. For example, if the FSP resistance increases by 5% relative to a peak strength aged version of the product, the AP resistance would decrease by not more than 4.5% relative to the peak strength aged version of the product. In other embodiments, the AP resistance is decreased by not greater than about 80%, or not greater than about 70%, or not greater than about 60%, or not greater than about 50%, or not greater than about 40%, or not greater than about 30%, or not greater than about 20%, or not greater than about 10%, or less, than the increase in FSP resistance. AP and FSP resistance criteria can be selected based in this known trade-off, e.g., using FSP and AP testing results relative to a known amount of underaging for an aluminum alloy product form. Thus, aluminum alloy product having tailored ballistics performance may be produced.

Referring now to FIG. 2, the preparing the aluminum alloy product for aging step (220) may include one or more of the steps of casting (222) the aluminum alloy product (e.g., direct chill casting), scalping the cast aluminum alloy product (224), homogenizing the aluminum alloy product (226), working the aluminum alloy product (228) (e.g., hot working to form a wrought product), solution heat treating the aluminum alloy product (230), optional quenching the aluminum alloy product (232), and optional cold working the aluminum alloy product (234) (e.g., stretching, rolling). The working the aluminum alloy product steps (228 or 234) may include one or more of rolling, extruding and/or forging the aluminum alloy product, and before or after the solution heat treatment step.

Aluminum alloys useful in conjunction with the present methods include those aluminum alloys that exhibit an aging response, such as any of the 2XXX, 2XXX+Li and 7XXX series alloys. These alloys are known as heat treatable alloys. These heat treatable alloys contain amounts of soluble alloying elements that exceed the equilibrium solid solubility limit at room and moderately higher temperatures. The amount present may be less or more than the maximum that is soluble at the eutectic temperature.

Solution heat treatment (230) is achieved by heating aluminum alloy products to a suitable temperature, holding at that temperature long enough to allow constituents to enter into solid solution, and cooling rapidly enough to hold the constituents in solution. The solid solution formed at high temperature may be retained in a supersaturated state by cooling with sufficient rapidity to restrict the precipitation of the solute atoms as coarse, incoherent particles. Controlled precipitation of fine particles after the solution heat treatment (230) and quench (232) operations, called "aging", has been traditionally used to develop mechanical properties of heat treatable alloys.

As it relates to the present invention, and with reference now to FIGS. 2 and 3, the aging step (240) may be utilized to age the aluminum alloy product to a predetermined underaged condition to achieve the selected ballistics performance criteria. After solution heat treatment (230) and quench (232), most heat treatable alloys (e.g., 2XXX, 2XXX+Li, 7XXX) exhibit property changes at room temperature. This is called "natural aging" (242) and may start immediately after solution heat treatment (230) and the quench (232), or after an incubation period. The rate of property changes during natural aging varies from one alloy to another over a wide range, so that the approach to a stable condition may require only a few days or several years. Precipitation can be accelerated in these alloys, and their strengths further increased by heating above room temperature; this operation is referred to as "artificial aging" (244) and is also known to those skilled in the art as "precipitation heat treating."

The underaged aluminum alloy products described herein may be naturally aged (242), artificially aged (244) or both (246). If artificial aging (244) is completed, natural aging (242) may occur before and/or after artificial aging (244). Natural aging (242) may occur for a predetermined period of time prior to (244) artificial aging (e.g., from a few hours to a few weeks, or more). A period of natural aging at room temperature may occur between or after any of the solution heat treatment (230), quenching (232), optional cold work (234) and optional artificial aging (244) steps noted above. (see, American National Standard Alloy and Temper Designation Systems for Aluminum, ANSI H35.1, which is incorporated herein by reference).

In some embodiments, no artificial aging step (244) is completed prior to supplying the product to the customer (300). That is, the aging step (240) consists of naturally aging (242). In these embodiments, the amount of natural aging (242) may be controlled to achieve an underaged condition (250) and the selected ballistics performance criteria. Concomitant to or after the natural aging step (242), the product may be subjected to various optional treatments (255), such as additional cold work after the aging step (240) or finishing operations (e.g., flattening, straightening, machining, anodizing, painting, polishing, buffing), after which the product may be supplied to the customer (300).

In some embodiments, the aging (240) comprises artificially aging (244). In these embodiments, the aging step (240) may include artificially heating the aluminum alloy product for a time and temperature that underages the product and achieves a strength below peak strength. In one embodiment, the artificial aging step (244) includes underaging the aluminum alloy product a predetermined amount to achieve the selected ballistics performance criteria (250), as described above. After artificial aging (244), the aluminum alloy product may be subjected to various optional post-age treatments (255), described above, after which the product may be supplied to the customer (300).

The new aluminum alloy products may realize at least equivalent performance to prior art products made from aluminum alloy 5083 in the H131 temper in terms of at least one property, while realizing an improved performance in at least one other property. This improved performance may be due to the unique processing of the new alloy, as provided above. The new alloys may achieve an improved combination of properties, such as an improved combination of density and ballistics performance, relative to a comparable 5083-H131 product.

The new underaged alloys may be utilized in any armor component where blasts may pose a threat, such as in armored vehicles, personal armor, and the like. In one embodiment, an armor component produced from the underaged alloy is spall resistant. A material is spall resistant if, during ballistics testing conducted in accordance with MIL-STD-662F (1997)), no substantial detachment or delamination of a layer of material in the area surrounding the location of impact occurs, as visually confirmed by those skilled in the art, which detachment or delamination may occur on either the front or rear surfaces of the test product.

As noted above, aluminum alloys suitable for use with the present method include the 2XXX, 2XXX+Li and 7XXX aluminum alloys. 2XXX aluminum alloys are aluminum alloys that contain copper (Cu) as the main alloying ingredient. 2XXX generally include from about 0.7 wt. % to about 6.8 wt. % Cu. 2XXX aluminum alloys may include other ingredients, such as magnesium (Mg) (e.g., from about 0.1 wt. % to about 2.0 wt. % Mg). Examples of some 2XXX aluminum alloys that may be useful in accordance with the underaging practice described herein include Aluminum Association alloys 2001, 2002, 2004, 2005, 2006, 2007, 2007A, 2007B, 2008, 2009, 2010, 2011, 2011A, 2111, 2111A, 2111B, 2012, 2013, 2014, 2014A, 2214, 2015, 2016, 2017, 2017A, 2117, 2018, 2218, 2618, 2618A, 2219, 2319, 2419, 2519, 2021, 2022, 2023, 2024, 2024A, 2124, 2224, 2224A, 2324, 2424, 2524, 2025, 2026, 2027, 2028, 2028A, 2028B, 2028C, 2030, 2031, 2032, 2034, 2036, 2037, 2038, 2039, 2139, 2040, 2041, 2044, 2045, and 2056, among other 2XXX aluminum alloys.

2XXX+Li aluminum alloys are 2XXX aluminum alloys that include purposeful additions of lithium (Li). 2XXX+Li alloys may contain up to about 2.6 wt. % Li (e.g., 0.1 to 2.6 wt. % Li). Examples of some suitable 2XXX+Li alloys that may be useful in accordance with the underaging practice described herein include Aluminum Association alloys 2050, 2090, 2091, 2094, 2095, 2195, 2196, 2097, 2197, 2297, 2397, 2098, 2198, 2099, and 2199, among other 2XXX+Li aluminum alloys. 2XXX+Li alloys generally contain at least about 0.5 wt. % Li.

Both the 2XXX and 2XXX+Li alloys may contain up to 1.0 wt. % Ag (e.g. 0.1-1.0 wt. % Ag). Silver (Ag) is known to enhance strength in such alloys. When used, Ag is usually present in amounts of at least about 0.10 wt. %.

Ballistics products made from 2XXX and 2XXX+Li aluminum alloys may achieve suitable ballistics performance properties by either natural aging alone, or by artificial aging. Thus, the 2XXX and 2XXX+Li aluminum alloy products may be supplied, for example, in the T3, T4, T6 or T8 tempers, among others.

7XXX aluminum alloys are aluminum alloys that contain zinc (Zn) as the main alloying ingredient. 7XXX generally include from about 3.0 wt. % to 12.0 wt. % Zn. 7XXX alloys may include other ingredients, such as Cu (0.1-3.5 wt. %) and Mg (0.1-3.5 wt. %). Examples of some 7XXX alloys that may be useful in accordance with the underaging practice described herein include Aluminum Association alloys 7003, 7004, 7204, 7005, 7108, 7108A, 7009, 7010, 7012, 7014, 7015, 7016, 7116, 7017, 7018, 7019, 7019A, 7020, 7021, 7022, 7122, 7023, 7024, 7025, 7026, 7028, 7029, 7129, 7229, 7030, 7032, 7033, 7034, 7035, 7035A, 7036, 7136, 7037, 7039, 7040, 7140, 7041, 7046, 7046A, 7049, 7049A, 7149, 7249, 7349, 7449, 7050, 7050A, 7150, 7250, 7055, 7155, 7255, 7056, 7060, 7064, 7068, 7168, 7075, 7175, 7475, 7076, 7178, 7278, 7278A, 7081, 7085, 7090, 7093, and 7095, among other 7XXX alloys.

7XXX generally achieve suitable ballistics performance properties by artificial aging, although natural aging alone could be utilized in some circumstances. Thus, the 7XXX aluminum alloy products may be supplied, for example, in the T6 or T8 tempers, among others.

It is anticipated that the underaging principles outlined herein may also be useful with some other precipitation hardening style alloys (e.g., one or more of the 6XXX aluminum alloys and/or one or more of the 8XXX aluminum alloys).

The aluminum alloy products generally comprise (and in some instances consists essentially of) the above identified ingredients, the balance being aluminum, optional additives (e.g., up to about 2.5 wt. %), and unavoidable impurities. Generally, the amount of ingredients, optional additives, and unavoidable impurities employed in the alloy should not exceed the solubility limit of the alloy. Optional additives include grain structure control materials (sometimes called dispersoids), grain refiners, and/or deoxidizers, among others, as described in further detail below. Some of the optional additives used in the aluminum alloy products may assist the alloy in more ways than described below. For example, additions of Mn can help with grain structure control, but Mn can also act as a strengthening agent. Thus, the below description of the optional additives is for illustration purposes only, and is not intended to limit any one additive to the functionality described.

The optional additives may be present in an amount of up to about 2.5 wt. % in total. For example, Mn (1.5 wt. % max), Zr (0.5 wt. % max), and Ti (0.10 wt. % max) could be included in the alloy for a total of 2.1 wt. %. In this situation, the remaining other additives, if any, could not total more than 0.4 wt. %. In one embodiment, the optional additives are present in an amount of up to about 2.0 wt. % in total. In other embodiments, the optional additives are present in an amount of up to about 1.5 wt. %, or up to about 1.25 wt. %, or up to about 1.0 wt. % in total.

Grain structure control materials are elements or compounds that are deliberate alloying additions with the goal of forming second phase particles, usually in the solid state, to control solid state grain structure changes during thermal processes, such as recovery and recrystallization. For the aluminum alloys disclosed herein, Zr and Mn are useful grain structure control elements. Substitutes from Zr and/or Mn (in whole or in part) include Sc, V, Cr, and Hf, to name a few. The amount of grain structure control material utilized in an alloy is generally dependent on the type of material utilized for grain structure control and the alloy production process.

The aluminum alloy products may optionally include manganese (Mn). Manganese may serve to facilitate increases in strength and/or a facilitate a refined grain structure, among other things, especially the 2XXX or 2XXX+Li aluminum alloys. When manganese is included in the aluminum alloy product, it is generally present in amounts of at least about 0.05 wt. %. In one embodiment, the new aluminum alloy product includes at least about 0.10 wt. % Mn. In one embodiment, the new aluminum alloy product includes not greater than about 1.5 wt. % Mn. In other embodiments, the new aluminum alloy product includes not greater than about 1.0 wt. % Mn.

When zirconium (Zr) is included in the aluminum alloy product, it may be included in an amount up to about 0.5 wt. %, or up to about 0.4 wt. %, or up to about 0.3 wt. %, or up to about 0.2 wt. %. In some embodiments, Zr is included in the alloy in an amount of 0.05-0.25 wt. %. In one embodiment, Zr is included in the alloy in an amount of 0.05-0.15 wt. %. In another embodiment, Zr is included in the alloy in an amount of 0.08-0.12 wt. %. 7XXX alloys generally use Zr as an optional additive.

Grain refiners are inoculants or nuclei to seed new grains during solidification of the alloy. An example of a grain refiner is a ⅜ inch rod comprising 96% aluminum, 3% titanium (Ti) and 1% boron (B), where virtually all boron is present as finely dispersed TiB2 particles. During casting, the grain refining rod is fed in-line into the molten alloy flowing into the casting pit at a controlled rate. The amount of grain refiner included in the alloy is generally dependent on the type of material utilized for grain refining and the alloy production process. Examples of grain refiners include Ti combined with B (e.g., TiB2) or carbon (TiC), although other grain refiners, such as Al—Ti master alloys may be utilized. Generally, grain refiners are added in an amount of ranging from 0.0003 wt. % to 0.005 wt. % to the alloy, depending on the desired as-cast grain size. In addition, Ti may be separately added to the alloy in an amount up to 0.03 wt. % to increase the effectiveness of grain refiner. When Ti is included in the alloy, it is generally present in an amount of up to about 0.10 or 0.20 wt. %.

Some alloying elements, generally referred to herein as deoxidizers (irrespective of whether the actually deoxidize), may be added to the alloy during casting to reduce or restrict (and is some instances eliminate) cracking of the ingot resulting from, for example, oxide fold, pit and oxide patches. Examples of deoxidizers include Ca, Sr, Be, and Bi. When calcium (Ca) is included in the alloy, it is generally present in an amount of up to about 0.05 wt. %, or up to about 0.03 wt. %. In some embodiments, Ca is included in the alloy in an amount of 0.001 to about 0.03 wt. % or to about 0.05 wt. %, such as in the range of 0.001-0.008 wt. % (i.e., 10 to 80 ppm). Strontium (Sr) and/or bismuth (Bi) may be included in the alloy in addition to or as a substitute for Ca (in whole or in part), and may be included in the alloy in the same or similar amounts as Ca. Traditionally, beryllium (Be) additions have helped to reduce the tendency of ingot cracking, though for environmental, health and safety reasons, some embodiments of the alloy are substantially Be-free. When Be is included in the alloy, it is generally present in an amount of up to about 500 ppm, such as less than about 250 ppm, or less than about 20 ppm.

The optional additives may be present in minor amounts, or may be present in significant amounts, and may add desirable or other characteristics on their own without departing from the alloy described herein, so long as the alloy retains the desirable characteristics described herein. It is to be understood, however, that the scope of this disclosure should not/cannot be avoided through the mere addition of an element or elements in quantities that would not otherwise impact on the combinations of properties desired and attained herein.

As used herein, unavoidable impurities are those materials that may be present in the alloy in minor amounts due to, for example, the inherent properties of aluminum and/or leaching from contact with manufacturing equipment, among others. Iron (Fe) and silicon (Si) are examples of unavoidable impurities generally present in aluminum alloys. The Fe content of the alloy should generally not exceed about 0.25 wt. %. In some embodiments, the Fe content of the alloy is not greater than about 0.15 wt. %, or not greater than about 0.10 wt. %, or not greater than about 0.08 wt. %, or not greater than about 0.05 or 0.04 wt. %. Likewise, the Si content of the alloy should generally not exceed about 0.25 wt. %, and is generally less than the Fe content. In some embodiments, the Si content of the alloy is not greater than about 0.12 wt. %, or not greater than about 0.10 wt. %, or not greater than about 0.06 wt. %, or not greater than about 0.03 or 0.02 wt. %. In some embodiments, zinc (Zn) may be included in the alloy as an unavoidable impurity (e.g., for 2XXX+Li alloys). In these embodiments, the amount of Zn in the alloy generally does not exceed 0.25 wt. %, such as not greater than 0.15 wt. %, or even not greater than about 0.05 wt. %. When not an impurity, up to 1.5 wt. % Zn may be used in the 2XXX or 2XXX+Li alloys (e.g., 0.3-1.5 wt. % Zn). Aside from iron, silicon, and zinc, the alloy generally contains no more than 0.05 wt. % of any one other unavoidable impurity, and with the total amount of these other unavoidable impurities not exceeding 0.15 wt. % (commonly referred to as others each ≤0.05 wt. %, and others total ≤0.15 wt. %, as reflected in the Aluminum Association wrought alloy registration sheets, called the Teal Sheets).

Except where stated otherwise, the expression "up to" when referring to the amount of an element means that that elemental composition is optional and includes a zero amount of that particular compositional component. Unless stated otherwise, all compositional percentages are in weight percent (wt. %).

While the above properties have generally been described relative to wrought alloys, it is expected that the underaging of cast aluminum alloy products would realize the same benefit, and thus underaging of cast aluminum alloy products is also included in the scope of the present invention.

BRIEF DESCRIPTION OF THE DRAWINGS

FIGS. 7*a*-7*f* are photographs (top view) illustrating the FSP penetration results of Example 1 relating to AA7085.

FIG. 17*a* is a SEM photograph illustrating cracks in AA7085-OA2 after FSP testing.

FIG. 17*b* is a close-up of FIG. 17*a*.

DETAILED DESCRIPTION

Example 1

Testing of 7XXX Alloys

V50 Testing

Figure 1:
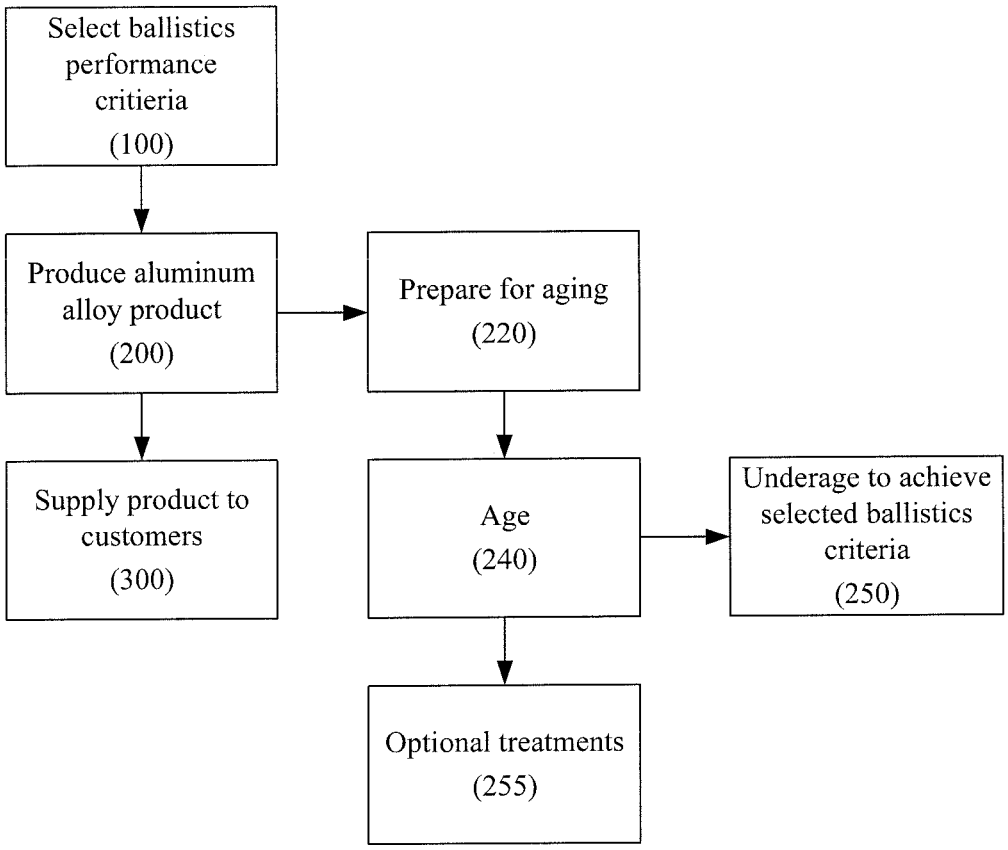
FIG. 1 is a flow chart illustrating one embodiment of producing an aluminum alloy product.
Figure 2:
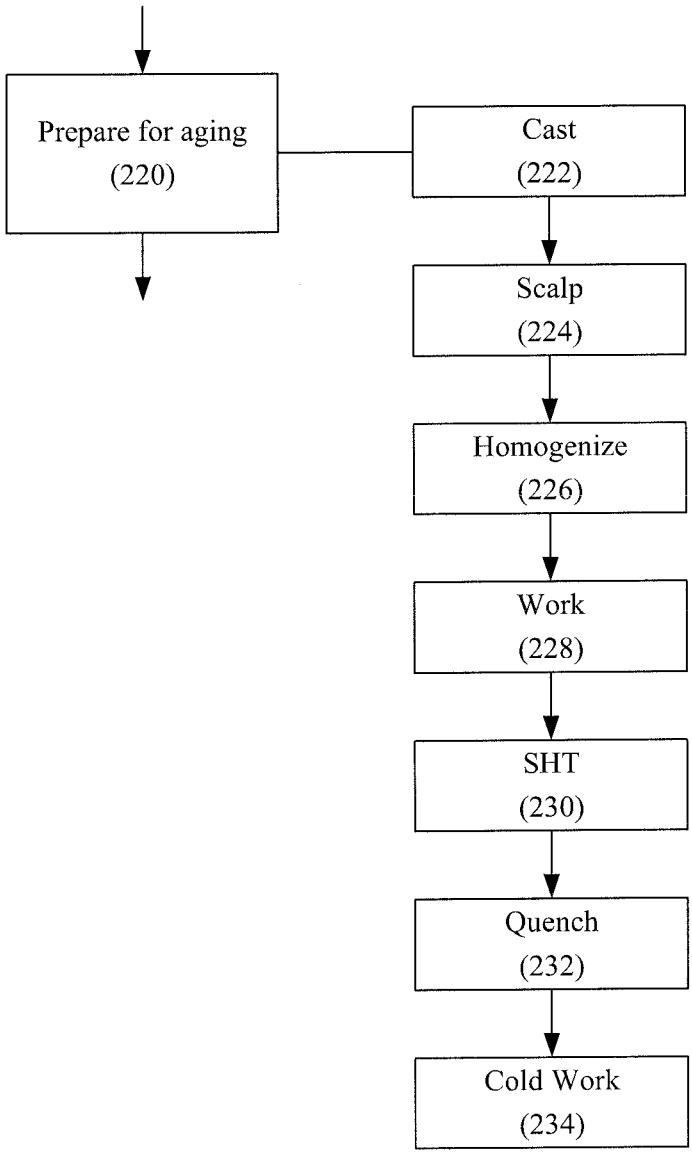
FIG. 2 is a flow chart illustrating the producing step (200) of FIG. 1.
Figure 3:
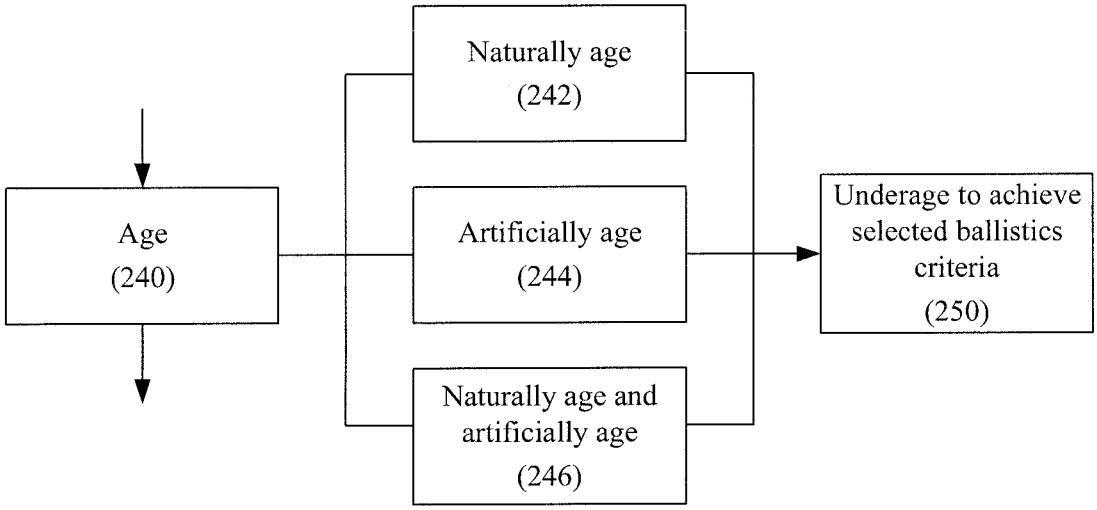
FIG. 3 is a flow chart illustrating the aging step (240) of FIG. 2.
Figure 4:
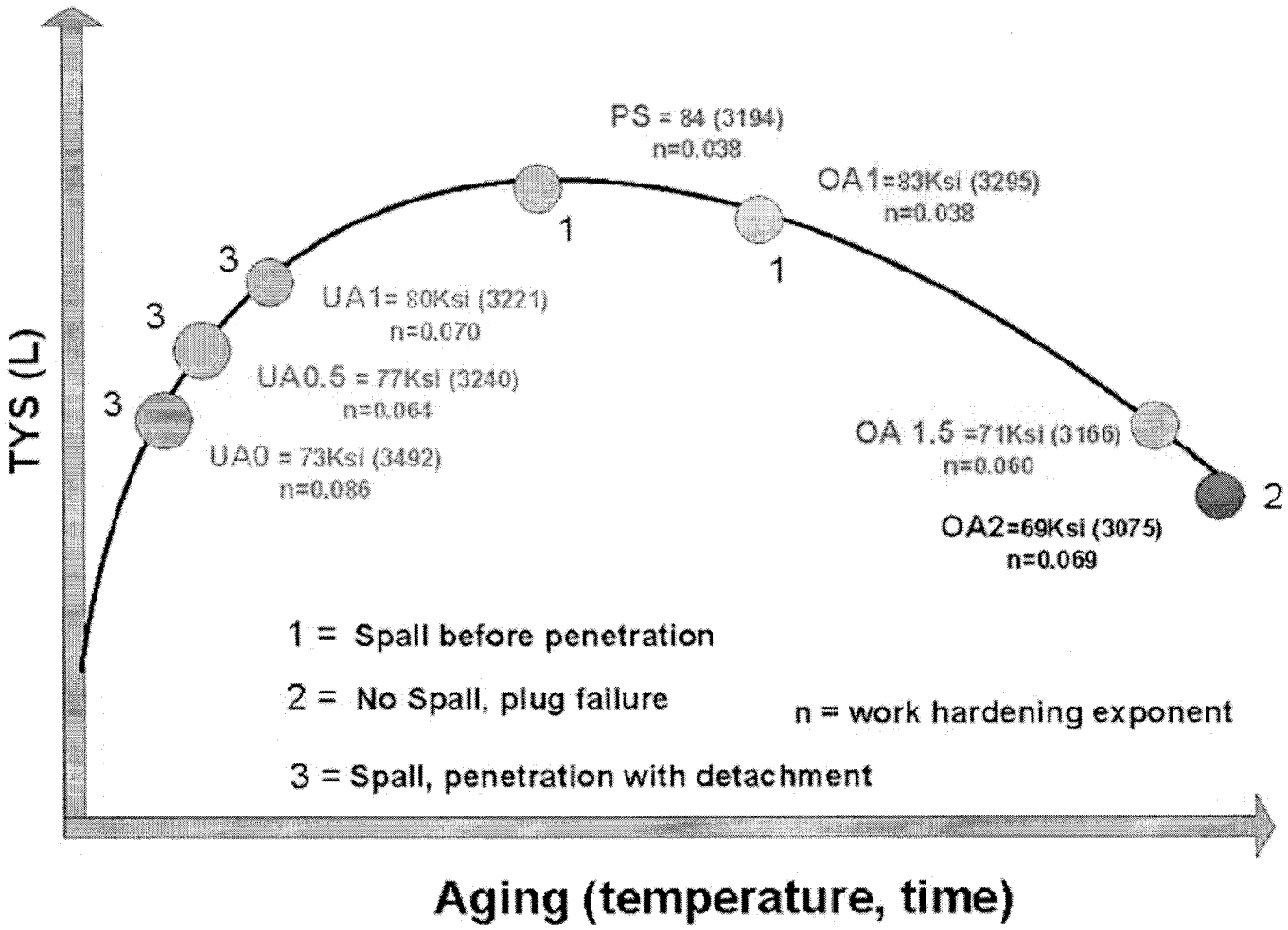
FIG. 4 is a schematic view illustrating the ballistics performance of AA alloy 7085 as a function of yield strength (TYS-L) and artificial aging conditions.
Figure 5:
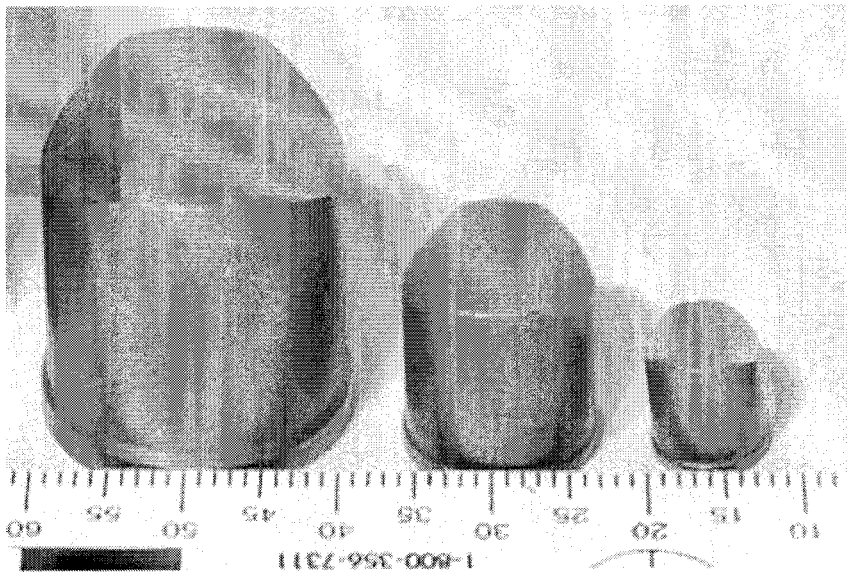
FIG. 5 is a photograph of projectiles that may be used for ballistics testing.

Aluminum association alloy 7085 is prepared for aging, similar to that illustrated in FIG. 2, and is tested for FSP performance in several artificially aged conditions. Two groups of AA 7085 plates with two different gauges, 1-inch and 2-inch, were artificially aged to different under-aged (UA) and over-aged (OA) conditions. For group 1 with 1-inch thick plates, seven aging conditions were generated: 7085-UA0, -UA0.5, -UA1, -PS, -OA1, -OA1.5, and -OA2 (FIG. 4). For UA plates in this group, at least three weeks of natural aging were obtained before artificial aging. The tensile yield strength (TYS) in the rolling direction (RD) of aged AA 7085 plates in group 1 falls in the range from 69 ksi to 83 ksi. AA 5083-H131 plates, 1-inch in thickness, were also tested as a benchmark. For group 2 with 2-inch thick plates, four aging conditions were generated: 7085-W51, -UA1, -OA1, and -OA2. Note W51 temper, solution heat treated with minimum aging, exhibited about 62 ksi in TYS of 2-inch thick plates. The TYS in the RD of aged AA 7085 plates in this group ranges from 62 ksi to 79 ksi. Fragment simulating projectile (FSP) ballistic tests were conducted for group 1 using 0.50-caliber projectile at Southwest Research Institute (SWRI) and group 2 using 20 mm projectile at Army Research Laboratory (ARL), respectively. For each alloy/condition in both groups, multiple 12-inch×12-inch specimens were tested. The projectiles used for FSP tests are shown in FIG. 5.

FIG. 4 illustrates the V50 measured for each aging condition of 1-inch thick plates subjected to the FSP ballistic test. The TYS and strain hardening rate (n) are also presented for each aging condition. The average V50 of under-aged AA 7085 plates, 3318 ft/s, was higher than 3179 ft/s, the average V50 of over-aged plates, which indicates better FSP ballistic resistance for under-aged plates. In particular, plates under the UA0 temper exhibited much better FSP ballistic resistance than other tempers. The maximum difference in V50 between UA (UA0) and OA (OA2) plates was 368 ft/s. V50s appeared to decrease with the progress of artificial aging, i.e., from UA to OA.

Figure 6A:
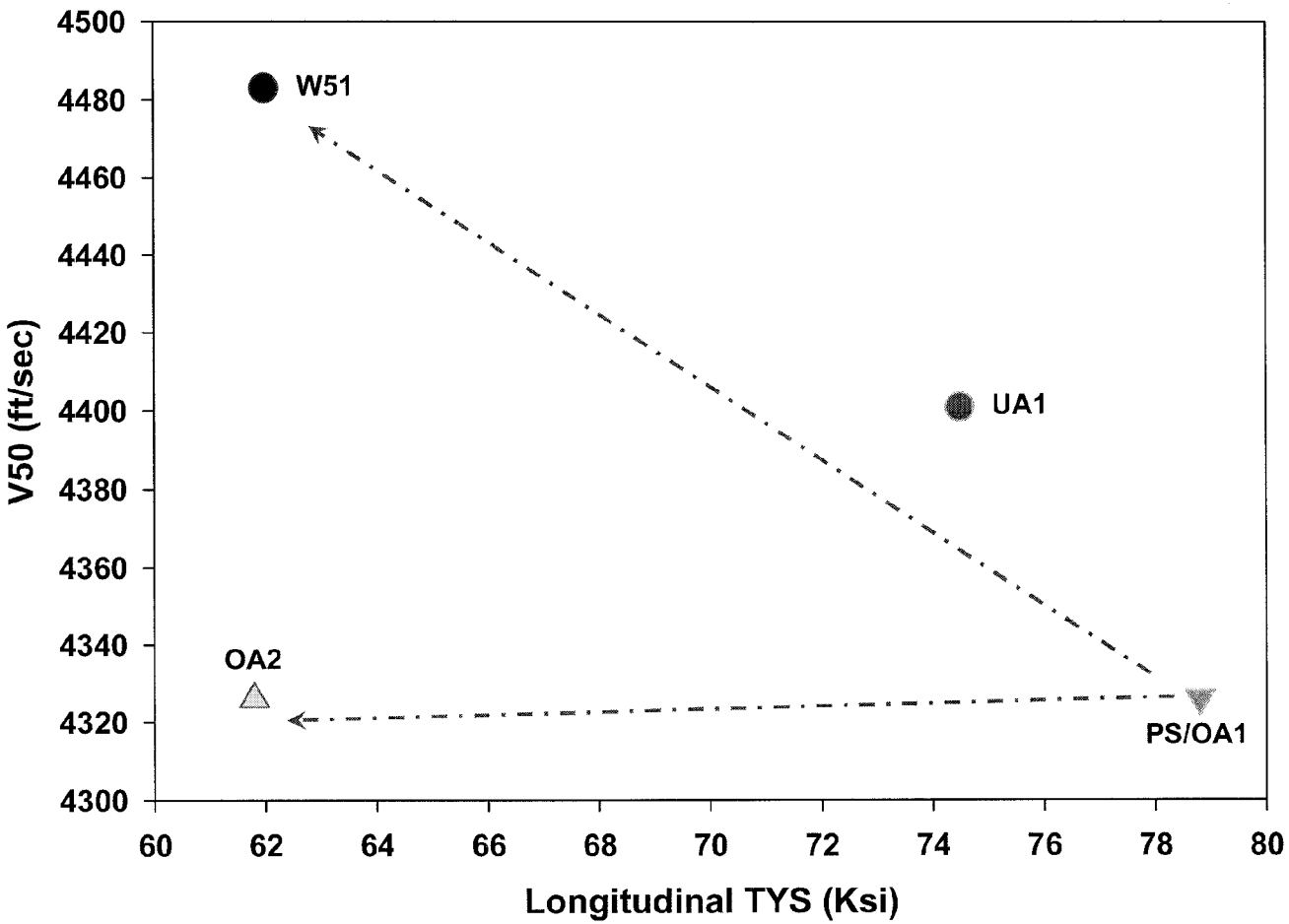
FIG. 6*a* is a graph illustrating the FSP resistance of various 2-inch thick aluminum alloy plates as a function of strength using a 0.50 caliber round as described in Example 1.

The relationship between V50 and TYS is also illustrated in FIG. 6*a*. The results show that V50 did not increase exclusively with either increasing TYS (FIG. 6*a*) or increasing strain hardening rate (FIG. 4). The V50, TYS, and strain hardening rate of the baseline material AA 5083-H131 were 1870 feet/second, 47 ksi, and 0.076, respectively. V50 of 5083-H131 was significantly lower than that of AA 7085 regardless of aging conditions. While its low ballistic resistance may be attributed to low TYS, AA 5083-H131 exhibited reasonably high strain hardening rate when compared to AA 7085 regardless of aging conditions.

Figure 6B:
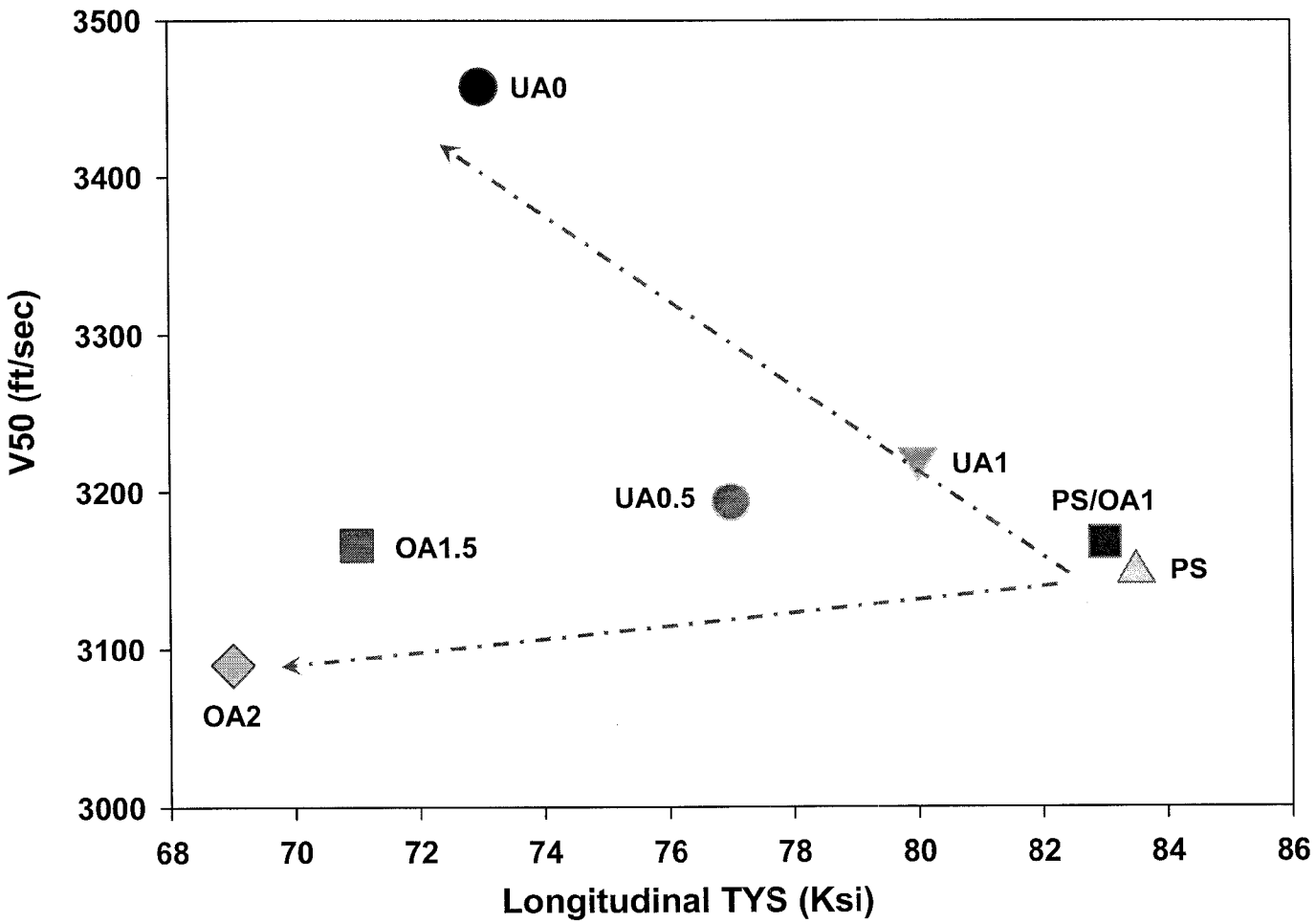
FIG. 6*b* is a graph illustrating the FSP resistance of various 2-inch thick aluminum alloy plates as a function of strength using 20 mm round as described in Example 1.

FIG. 6*b* shows the relationship between V50 and TYS of 2-inch thick plates tested with a larger FSP projectile (20 mm). The UA plates (W51 and UA1) achieved higher V50 than over-aged plates (OA1 and OA2); the same trend as that of 1-inch thick plates even though the maximum difference in V50 between UA (W51) and OA plates for 2-inch thick plates reduced to 157 ft/s. Note that the W51 temper represents only natural aging at room temperature. These results suggest that the maximum V50 can be achieved through underaging rather than over-aging of AA 7085 plates.

Figure 6C:
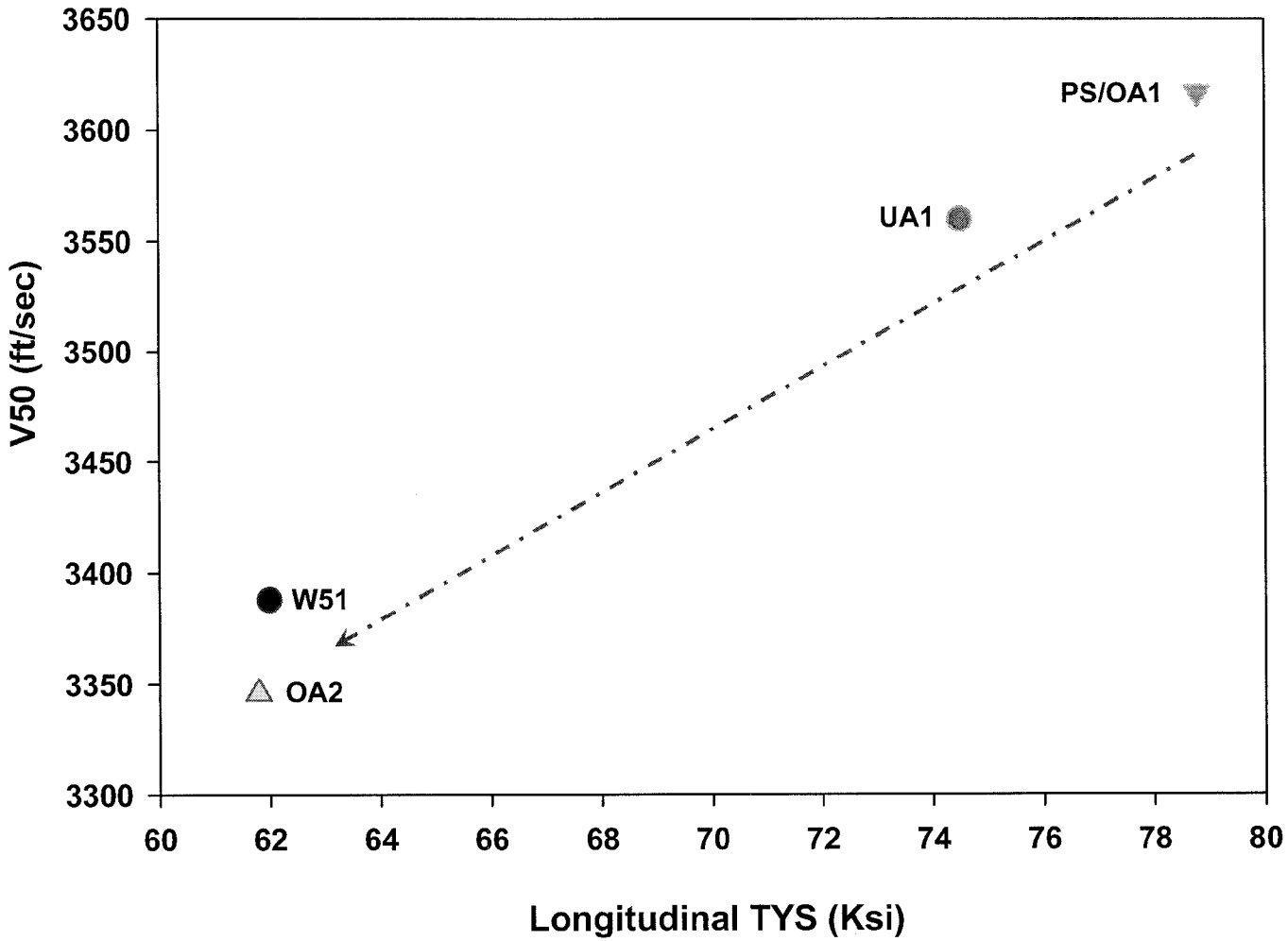
FIG. 6*c* is a graph illustrating the AP resistance of various 2-inch thick aluminum alloy plates as a function of strength as described in Example 1.

Armor piercing (AP) tests were also conducted, and the results are illustrated in FIG. 6*c*. AP resistance decreases with decreasing strength.

FIGS. 7*a*-7*f* are pictures of the 1-inch plates after the FSP ballistic tests. Both partial (FIGS. 7*a*, 7*c*, 7*e*) and full penetration (FIGS. 7*b*, 7*d*, 7*f*) photographs are shown. "TD" as used in stands for transverse direction. The failure of plates can be generally categorized into three modes:

Mode 1. Spall—penetration with detachment. The plate spalled during the partial penetration test, but to a substantial less degree (FIG. 7*a*). Obviously, the plate spalled when projectile comes out of the plate during the full penetration test (FIG. 7*b*).

Mode 2. Spall—prior to penetration. As shown in FIG. 7*c*, the degree of spall during the partial penetration test in Mode 2 is significantly higher than in Mode 1, which marks the major difference in characteristics of spall between these two modes. There is no remarkable difference in spall for full penetrated plates between Mode 2 and Mode 1.

Mode 3. Plug without spall. Mode 3 is characterized by ejection of a plug. FIG. 7*e* shows the formation of the plug during partial penetration test. The plug was ejected during full penetration test.

Regarding spall, the failure mode of each experimental alloy (7085-UA0, -UA0.5, -UA1, -PS, -OA1, -OA1.5, and -OA2) was determined for the 1" plates, and is marked as "1", "2", and "3" for Mode 1, Mode 2, and Mode 3, respectively, in FIG. 4. The under-aged plates (UA0, UA0.5, and UA1) exhibit Mode 1 type of failure, while the peak strength (PS) and over-aged plates (OA1 and OA1.5) incur Mode 2 type of failure. The OA2 plates, substantially over-aged, shows Mode 3 type of failure, which is also the failure mode of benchmark AA 5083-H131 plates.

Microstructure Analysis

Figure 8A:
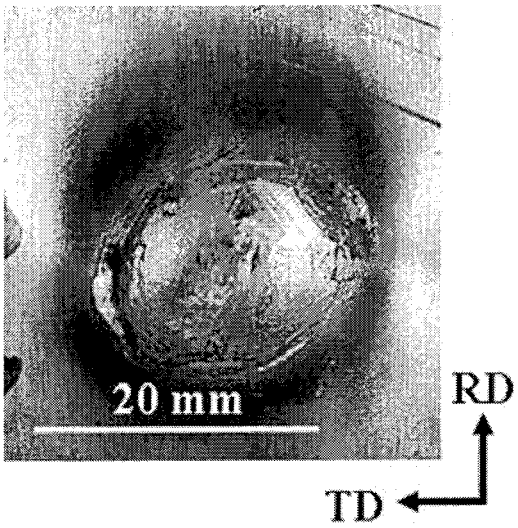
FIG. 8*a* is a photograph (top view) illustrating the FSP penetration results of Example 1 relating to prior art alloy AA5083.
Figure 8B:
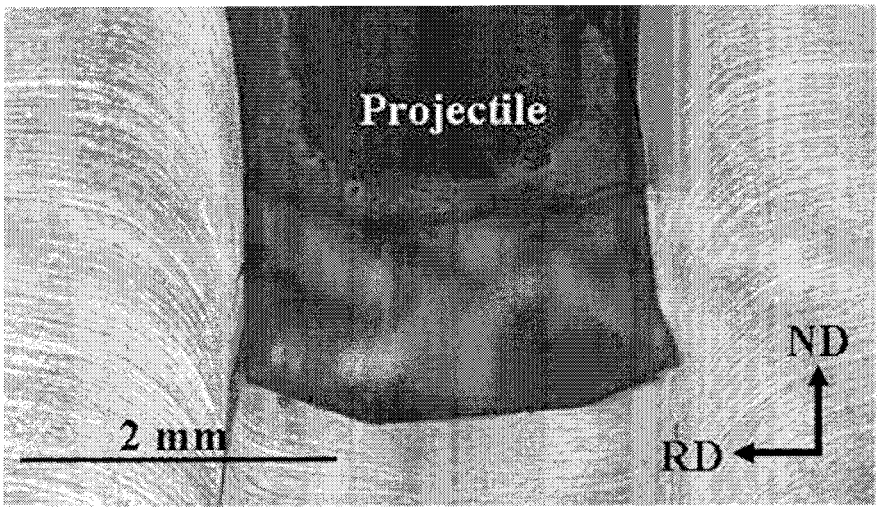
FIG. 8*b* is a photograph (cross-sectional view) illustrating the microstructure of prior art alloy AA5083 after FSP testing.
Figure 9:
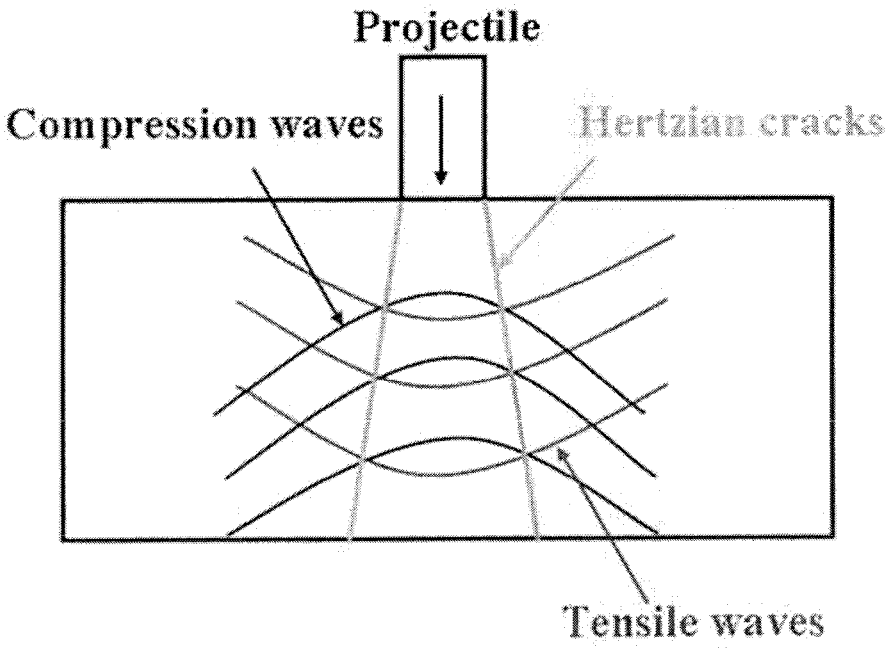
FIG. 9 is a schematic view illustrating one proposed embodiment of the method of crack formation in AA5083 as it relates to FSP testing.
Figure 10A:
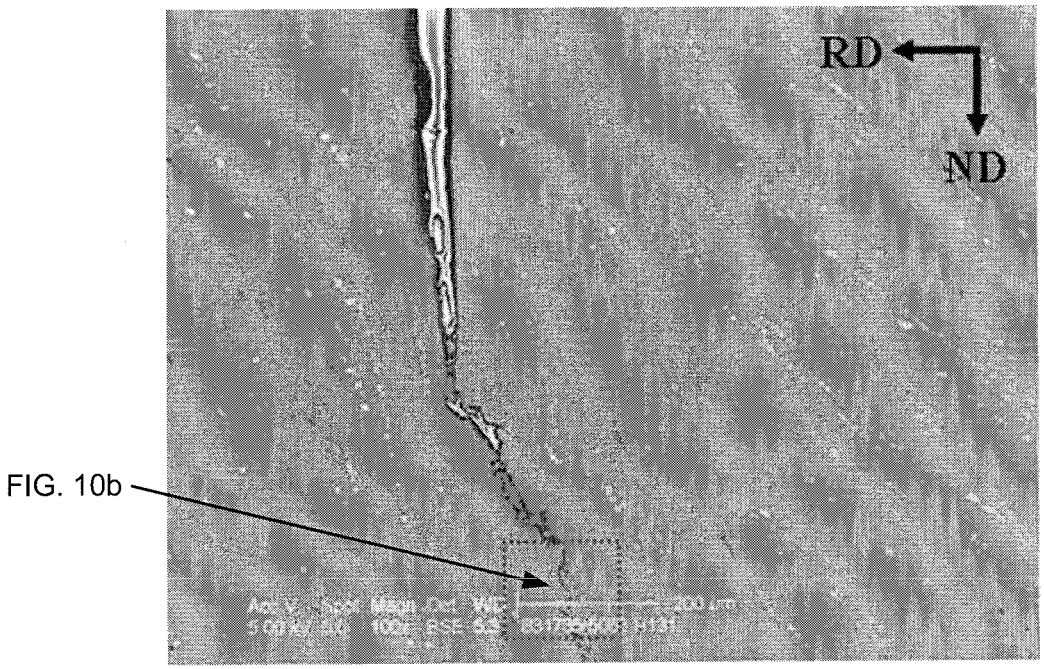
FIG. 10*a* is an SEM photograph illustrating cracking in AA5083 after FSP testing.
Figure 10B:
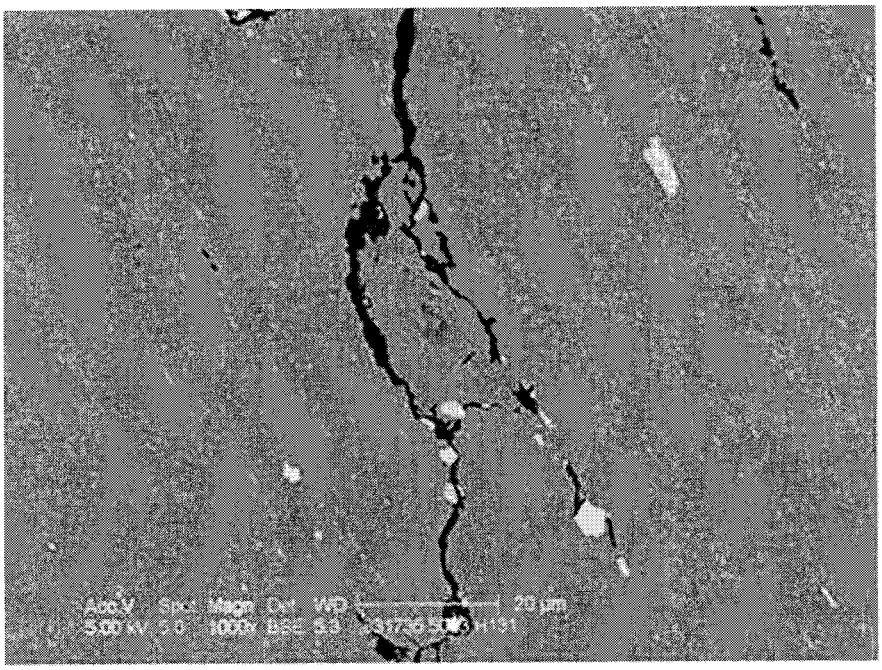
FIG. 10*b* is a close-up of a portion of FIG. 10*a*.

FIGS. 8*a*-8*b* illustrates the top view (FIG. 8*a*) and cross-section microstructure view (FIG. 8*b*) of an AA 5083-H131 plate subjected to the FSP ballistic test. Plug failure with indications of Hertzian cracks was observed. FIG. 9 illustrates one proposal relating to the formation of Hertzian cracks. The impact of the projectile generates compressive shock waves which reflect from the back surface and form tensile shock waves. The interaction of these waves results in severe shear and Hertzian cracks that eventually leads to plug failure. Such a plug failure mode is the major failure mode of benchmark AA 5083-H131 alloy subject to the FSP ballistic test. Some shear bands and small cracks extended from the major Hertzian cracks were also observed (FIG. 10*a*). The cracks are seen to propagate along coarse constituent particle bands (FIG. 10*b*).

FIG. 11 shows the cross-section microstructure of AA 7085-UA0 plate subjected to a FSP ballistic test. Cracks develop in the rolling direction (RD) that is perpendicular to the normal direction (ND), i.e., the moving direction of the projectile in the plate. The Hertzian cracks are not as severe as those observed in AA 5083-H131 plate. AA 7085-UA1, another under-aged condition, also shows development of cracks in the RD (FIG. 11). However, no Hertzian crack was observed even though some shear bands are present in AA 7085-UA1 plate. FIGS. 11*c* and 11*d* show microstructures of AA 7085-OA1 and -OA2 plates, respectively. Both cracks along the RD and Hertzian cracks are well developed in the AA 7085-OA1 plate. Interestingly, no cracks along the RD develop in AA 7085-OA2 plate in which Hertzian cracks developed in a very similar way as those did in AA 5083-H131 plate.

As described above, FIG. 4 illustrates that the failure mode of AA 7085 plates subjected to FSP ballistic test changes from Mode 1 (Spall—penetration with detachment) for under-aged conditions to Mode 3 (Plug without spall) for over-aged conditions. This is consistent with the above results, which show that the microstructure changes from cracks along the RD with very limited development of Hertzian cracks in under-aged plates to almost exclusive Hertzian cracks in over-aged conditions.

Figure 11A:
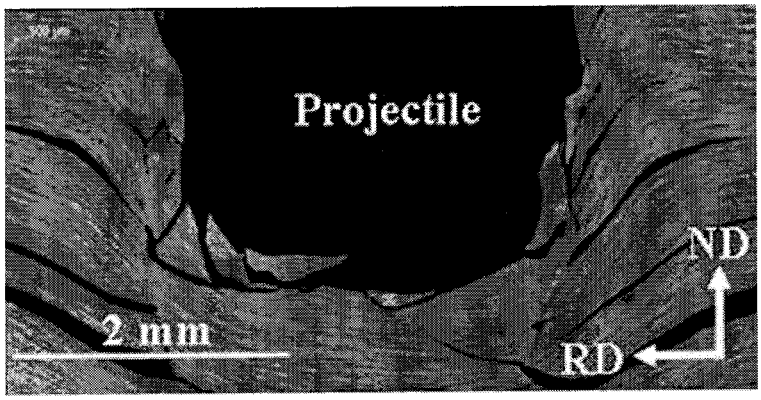
FIG. 11*a* is a photograph (cross-sectional view) illustrating the microstructure of alloy AA7085-UA0 after FSP testing.
Figure 11B:
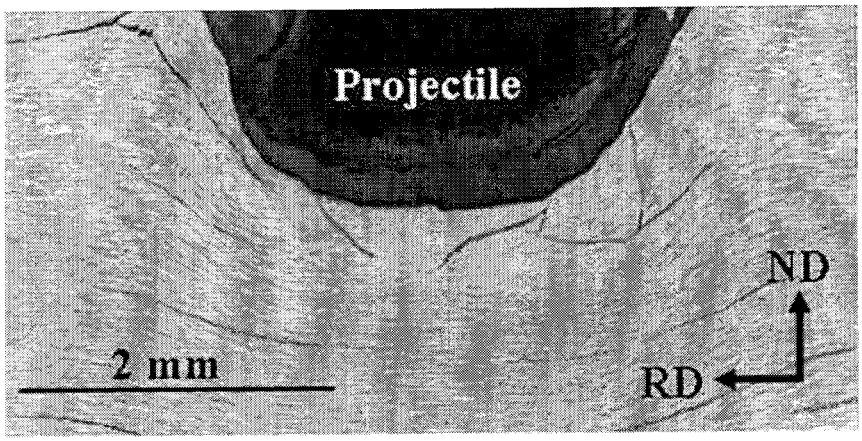
FIG. 11*b* is a photograph (cross-sectional view) illustrating the microstructure of alloy AA7085-UA1 after FSP testing.
Figure 11C:
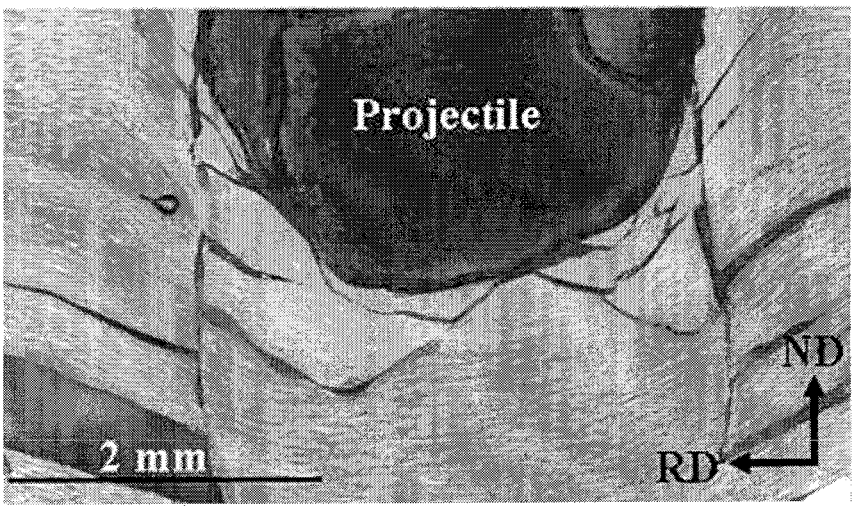
FIG. 11*c* is a photograph (cross-sectional view) illustrating the microstructure of alloy AA7085-OA1 after FSP testing.
Figure 11D:
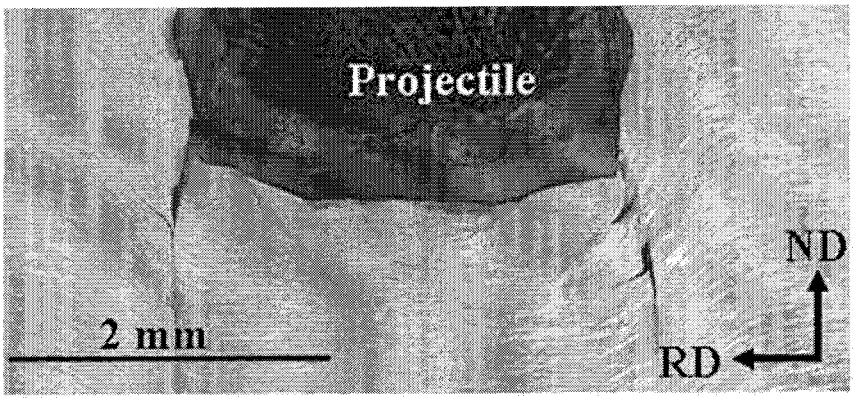
FIG. 11*d* is a photograph (cross-sectional view) illustrating the microstructure of alloy AA7085-OA2 after FSP testing.
Figure 12A:
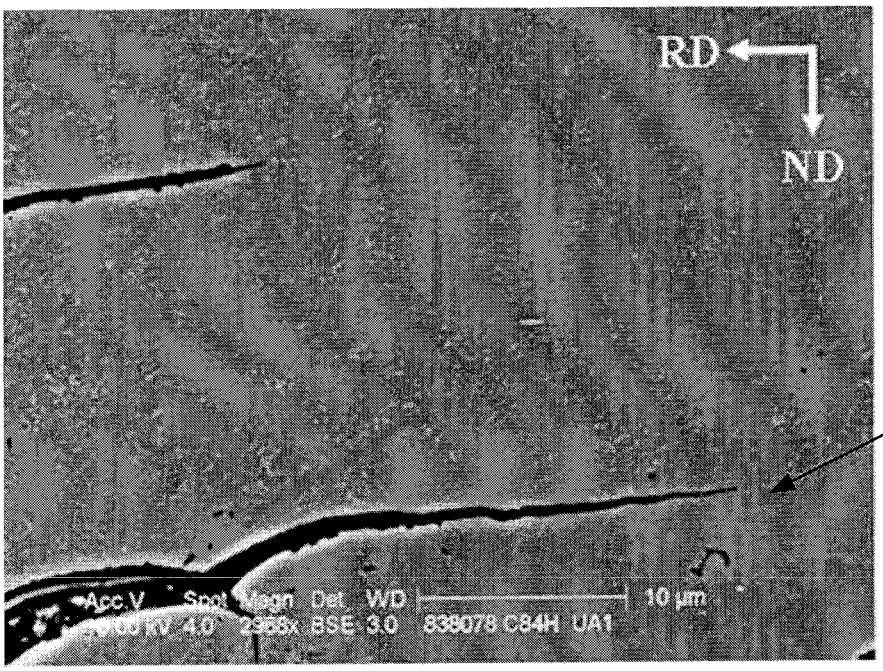
FIG. 12*a* is a SEM photograph illustrating cracking in AA7085-UA1 after FSP testing.
Figure 12B:
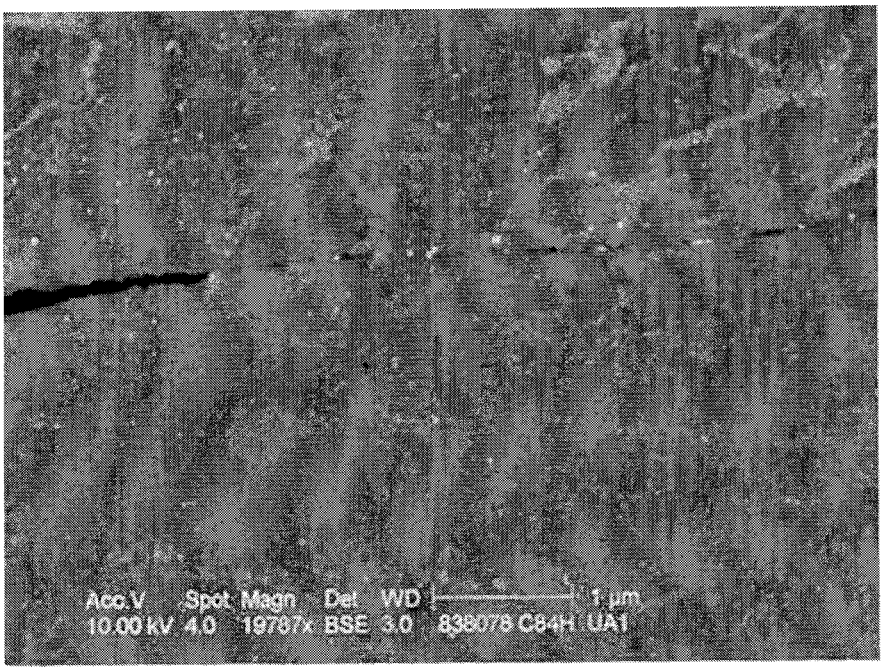
FIG. 12*b* is a close-up of a portion of FIG. 12*a*.
Figure 13A:
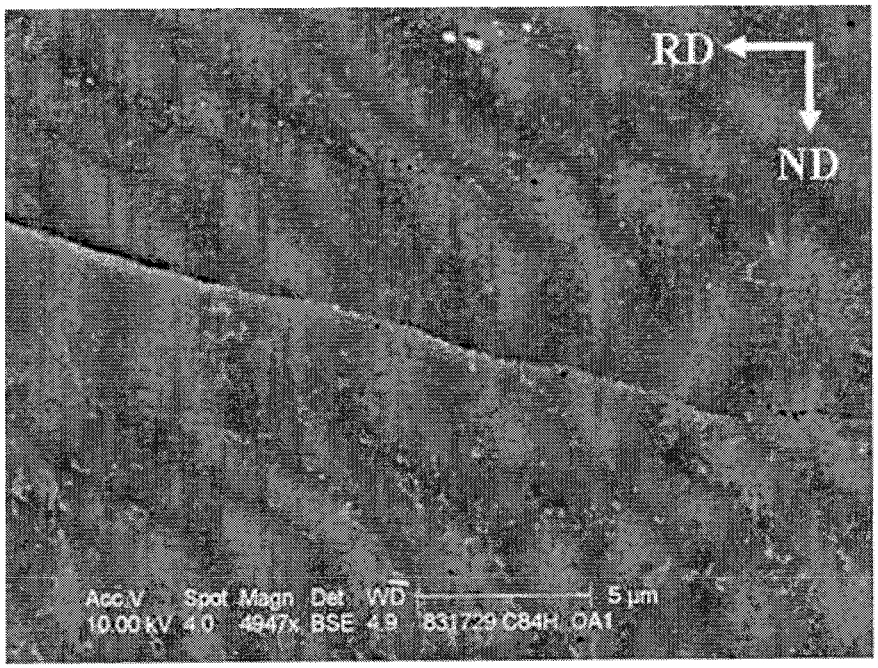
FIG. 13*a* is a SEM photograph illustrating cracking in AA7085-OA1 after FSP testing.
Figure 13B:
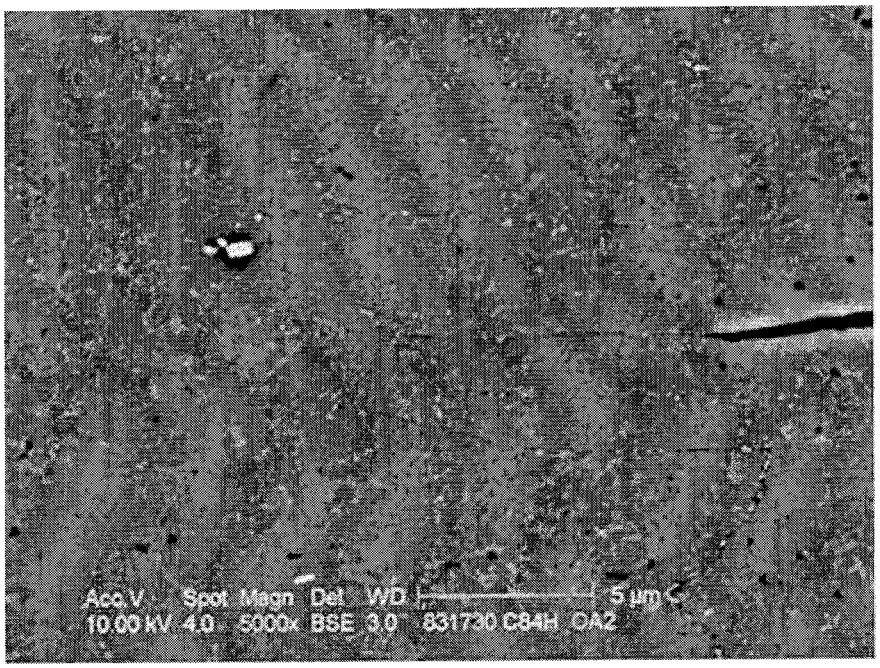
FIG. 13*b* is a SEM photograph illustrating cracking in AA7085-OA2 after FSP testing.

For AA7085-UA1 alloy, the cracks, almost parallel to RD as shown in FIG. 11*b*, appear to propagate along the grain boundaries that are almost parallel to the RD (FIG. 12*a*). Fine precipitates are seen on the grain boundary (FIG. 12*b*). Similar cracks were also observed in both AA 7085-OA1 (FIG. 13*a*), and AA7085-OA2 plates (FIG. 13*b*). This type of crack appears to involve no severe shear deformation.

Figure 14A:
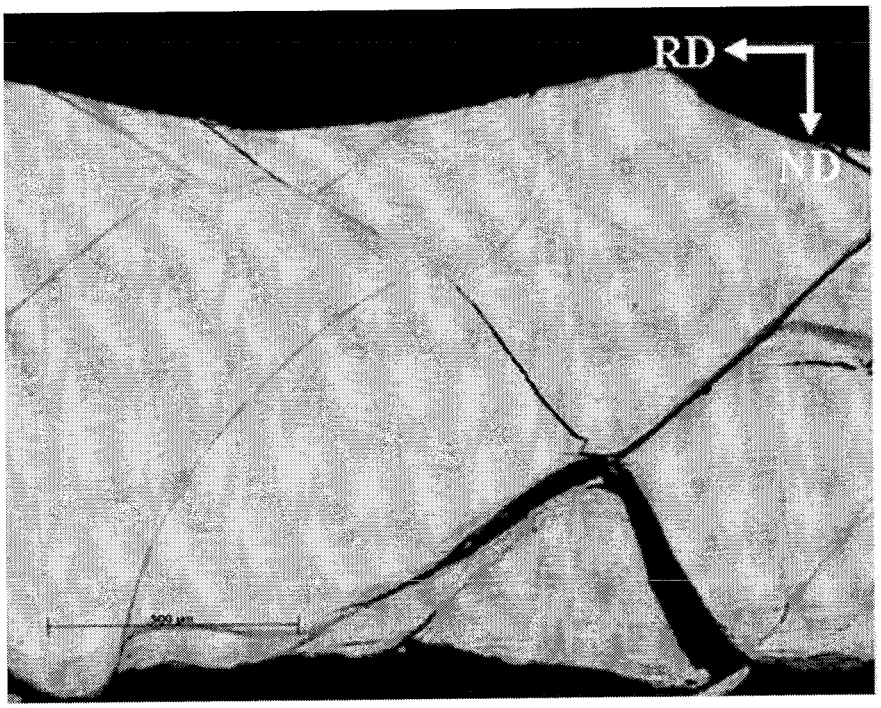
FIG. 14*a* is a SEM photograph of an etched sample of AA7085-UA1 after FSP testing.
Figure 14B:
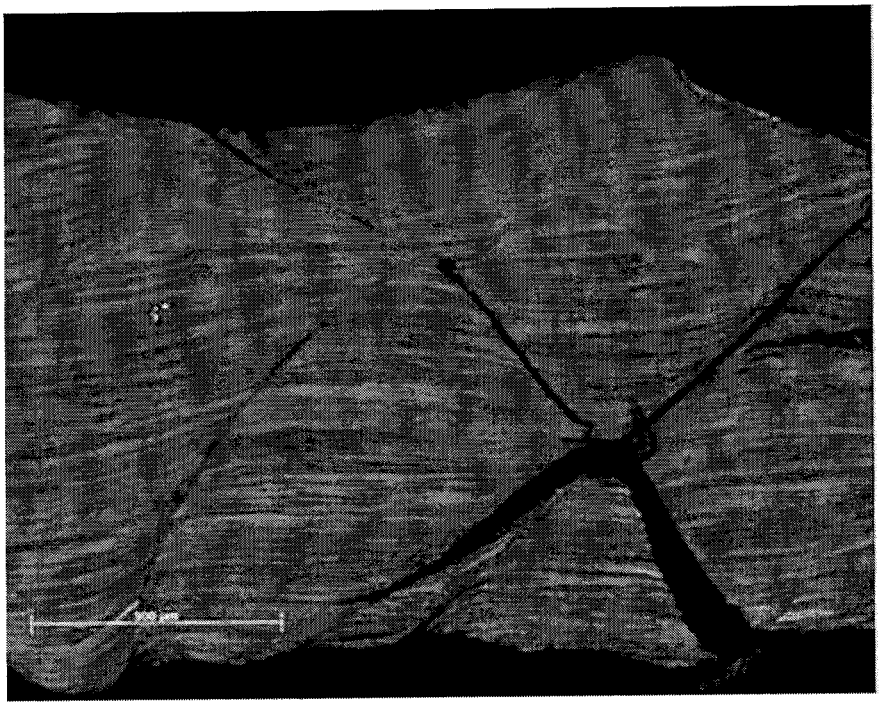
FIG. 14*b* is a SEM photograph of an anodized sample of AA7085-UA1 after FSP testing.
Figure 15A:
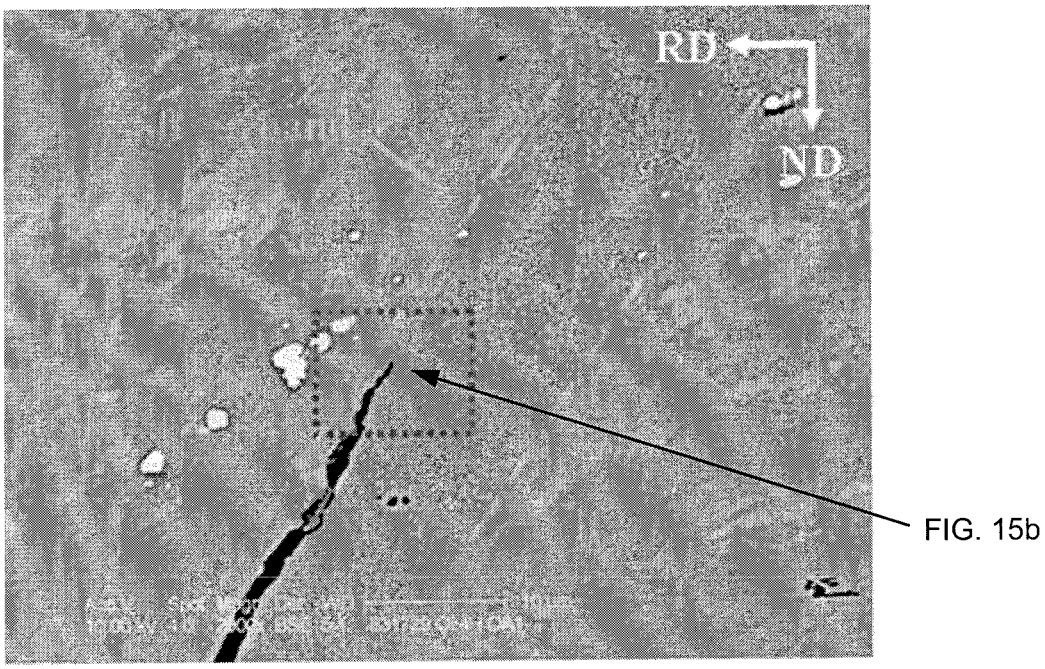
FIG. 15*a* is a SEM photograph illustrating shear bands in AA7085-OA1 after FSP testing.
Figure 15B:
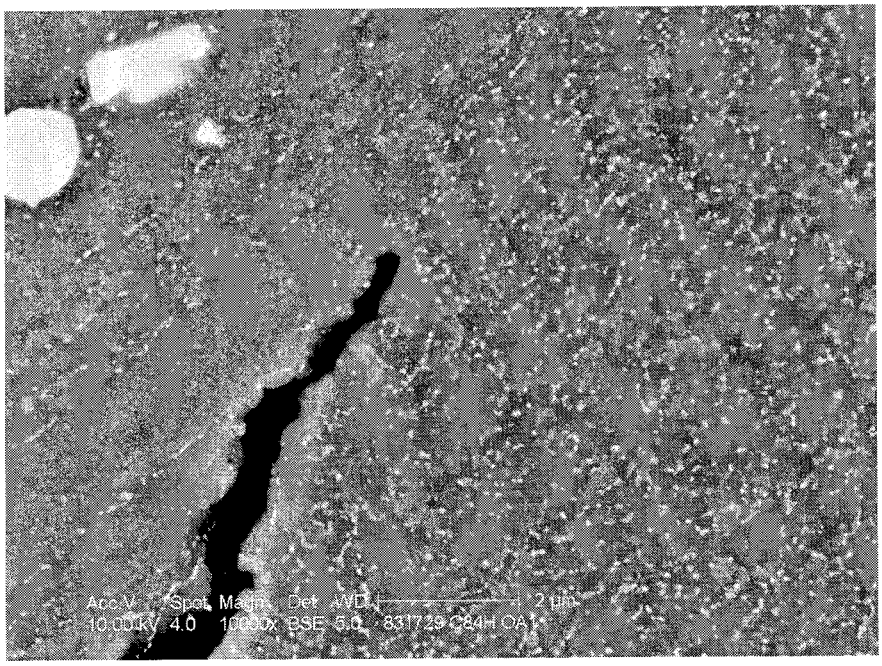
FIG. 15*b* is a close-up of FIG. 15*a* illustrating nanometer-sized precipitates in the shear bands.
Figure 16A:
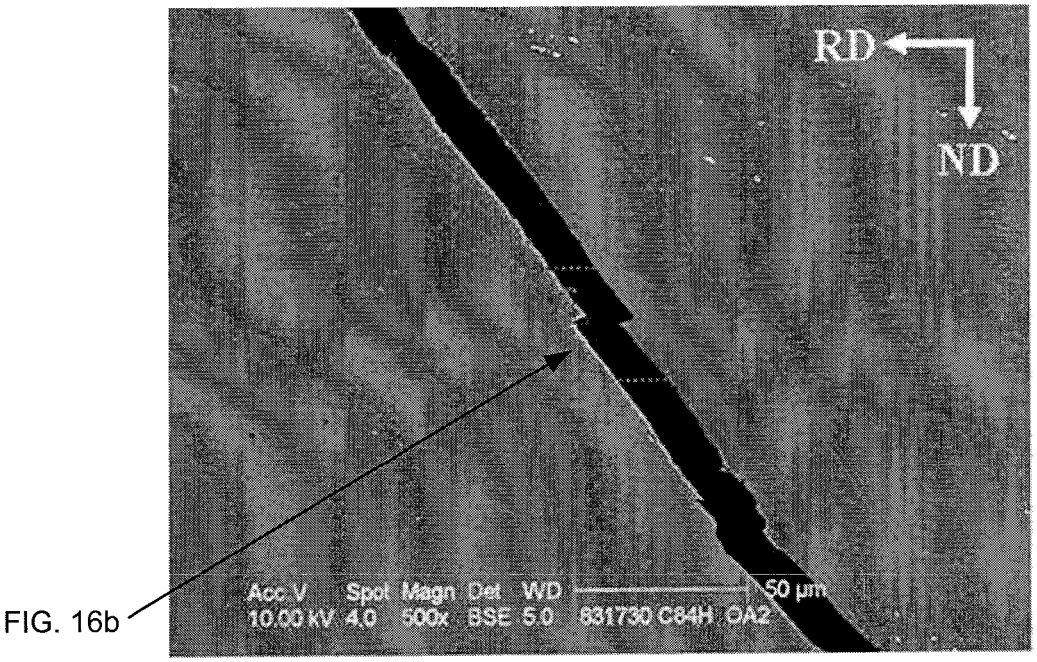
FIG. 16*a* is a SEM photograph illustrating shear bands in AA7085-OA1 after FSP testing.
Figure 16B:
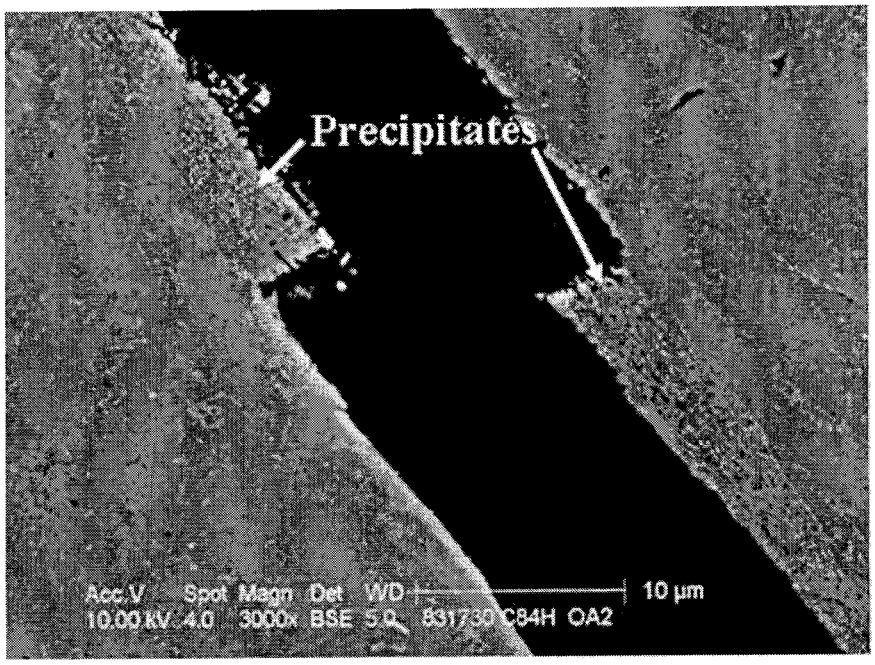
FIG. 16*b* is a close-up of FIG. 16*a*.

Another type of crack involves severe shear deformation. As shown in FIG. 14*a*, severe shear bands interact to create cracks. In this case, cracks propagate along the shear bands instead of grain boundaries (FIG. 14*b*). The figures illustrate that multiple transgranular shear bands are present at the crack sites. These shear bands are characterized as being parallel in nature at an angle of approximately 45 degree to the RD of the plate. Moreover, the shear bands are associated with small precipitates (FIGS. 15*a*-15*b*). The width of the shear band is about 15 to 20 microns (FIG. 15*a*). The small precipitates are seen uniformly distributed inside the shear band (FIG. 15*b*). FIG. 16*a* shows a crack due to shear deformation. The small precipitates can be found around the crack (FIG. 16*b*). FIGS. 17*a*-17*b* shows that cracks coalesce in AA 7085-OA2 plate. It can be seen that the large crack to be formed by coalescence of cracks is about 45 degree to the RD (FIG. 17*a*) even though each crack in coalescence appears to follow the grain boundary (FIG. 17*b*).

Figure 18A:
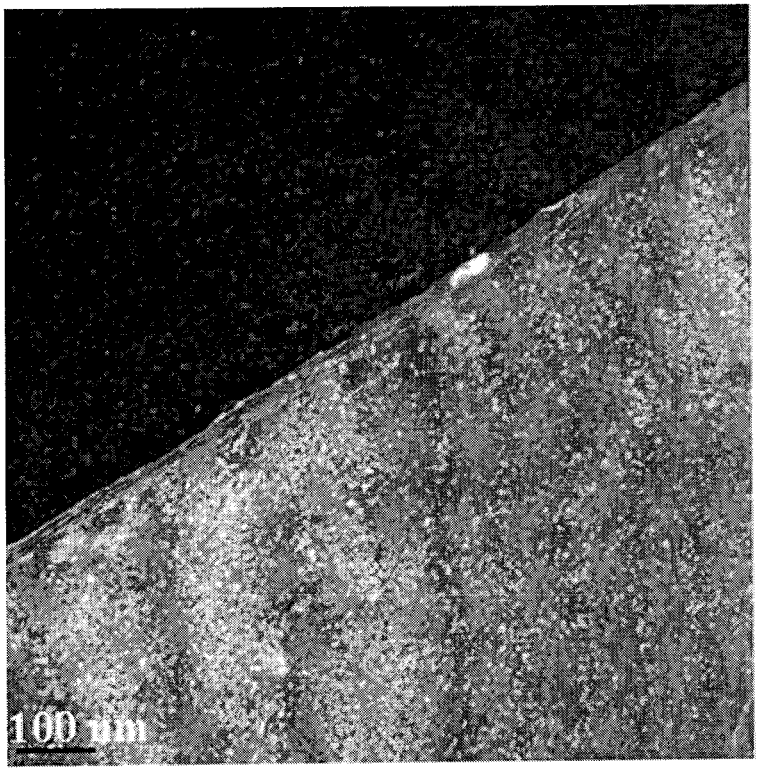
FIG. 18*a* is a TEM dark-filled photograph illustrating the microstructure of AA7085-UA1 after FSP testing.
Figure 18B:
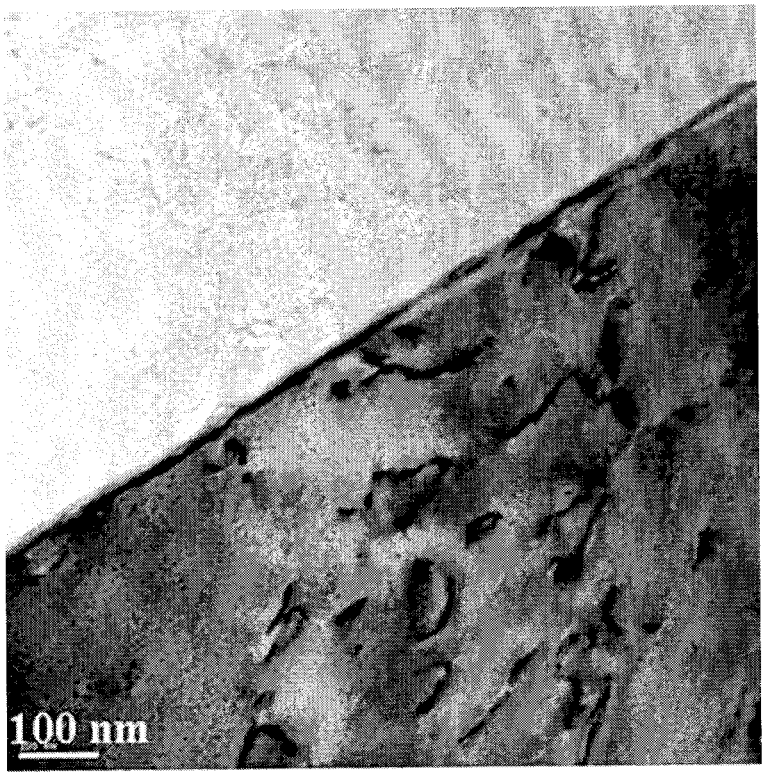
FIG. 18*b* is a TEM multi-beam bright field photograph illustrating the microstructure of AA7085-UA1 after FSP testing.
Figure 19A:
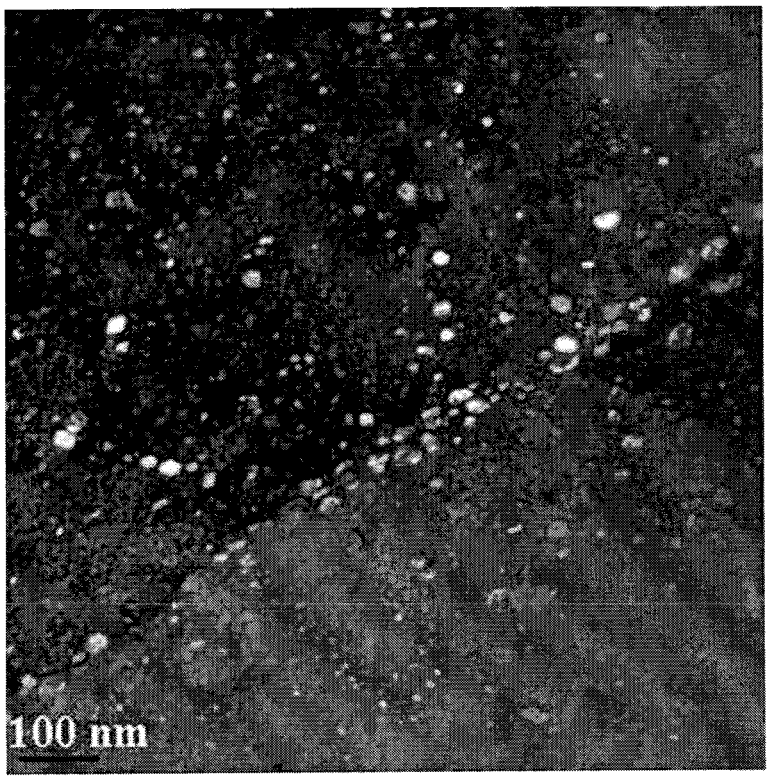
FIG. 19*a* is a TEM dark-filled photograph illustrating the microstructure of AA7085-OA1 after FSP testing.
Figure 19B:
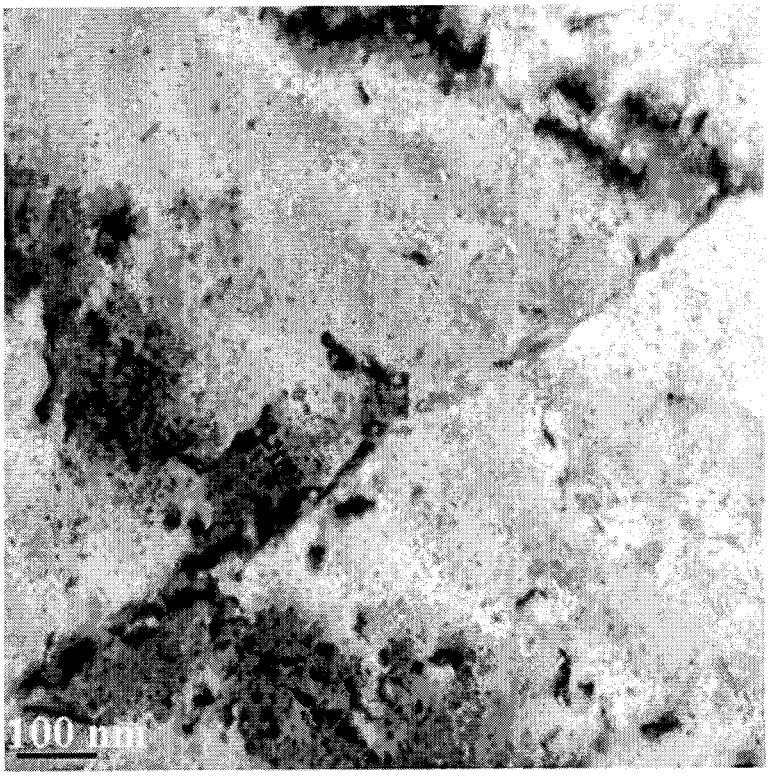
FIG. 19*b* is a TEM multi-beam bright field photograph illustrating the microstructure of AA7085-OA1 after FSP testing.
Figure 20A:
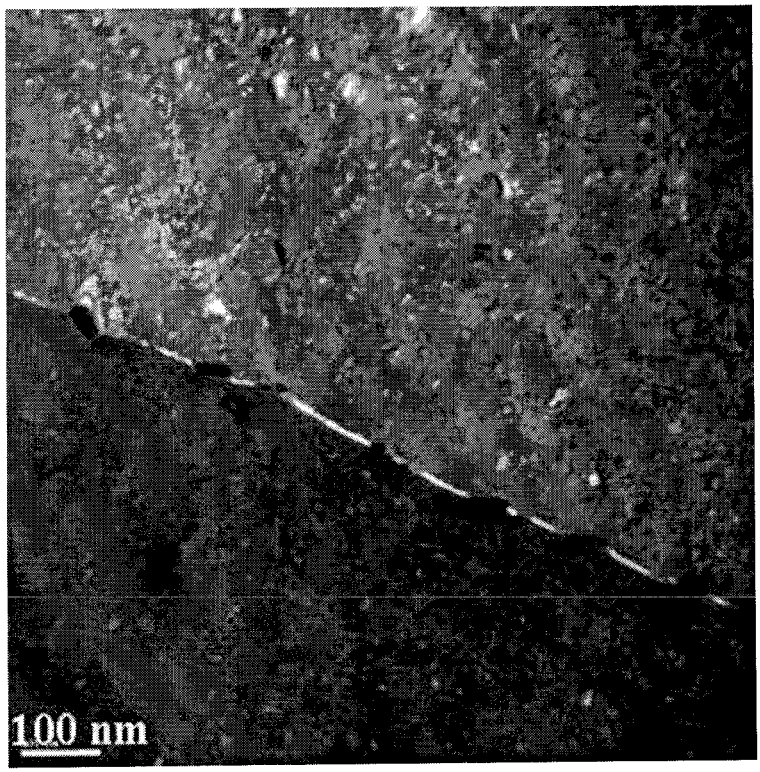
FIG. 20*a* is a TEM dark-filled photograph illustrating the microstructure of AA7085-OA2 after FSP testing.
Figure 20B:
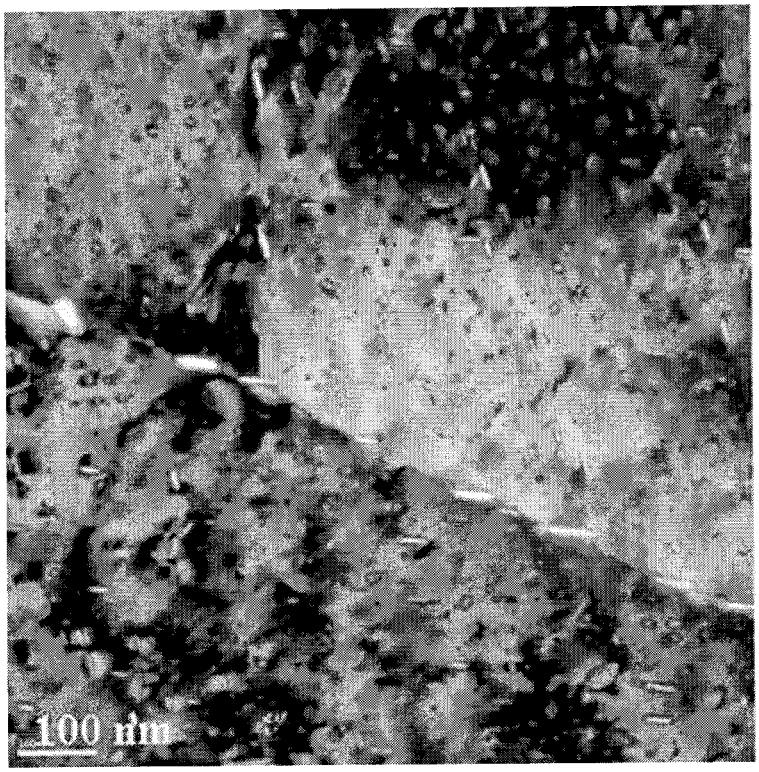
FIG. 20*b* is a TEM multi-beam bright field photograph illustrating the microstructure of AA7085-OA2 after FSP testing.

FIGS. 18*a*-18*b*, 19*a*-19*b* and 20*a*-20*b* show TEM images of grain boundaries in AA 7085-UA1, -OA1, and -OA2 plates, respectively. The TEM images are at the T/2 location from the LT-L plane of the product. FIGS. 18*a*, 19*a* and 20*a* are TEM dark field images (Z.A.=<110>). For FIGS. 18*a* and 19*a*, the dark field picture was taken from g=<111> from a high angle grain boundary. For FIG. 20*a*, the dark field picture was taken from g=<022> from a high angle grain boundary. As illustrated, the size and density of precipitates on the grain boundary increase with the progress of aging. More precipitates were seen on the grain boundary in OA1 condition (FIGS. 19*a*-19*b*) than in UA1 condition (FIGS. 18*a*-18*b*). The grain boundary was almost covered by precipitates in OA2 condition (FIGS. 20*a*-20*b*). The phases observed on the grain boundary are consistent with the M phase (MgZn2) based on Dark Field imaging conditions.

These results illustrate that aging may affect the ballistic resistance of AA 7085. FSP ballistic resistance in terms of V50 correlates to aging status: under-aged plates generally outperformed the over-aged plates in FSP ballistic resistance. Neither TYS nor strain hardening rate can explain such a trend, which suggests neither TYS nor strain hardening rate, alone, is a reliable indication of FSP ballistic resistance for AA 7085 plates.

The microstructural analysis shows that AA 7085 responds to FSP ballistic test differently depending upon the aging condition. Grain boundary precipitation appears to correlate with these different responses. For under-aged plates, the grain boundary contains very few precipitates, which helps maintain a high strength level of grain boundary. In contrast, the grain boundary of over-aged plates is characterized by intense precipitates, which reduces strength level of the grain boundary. High grain boundary strength of under-aged plates may explain high resistance to crack coalescence in the ND due to shear deformation. As a result, shock energy may be absorbed, and expended to propagate cracks in the RD for under-aged plates. The over-aged plates are prone to crack coalescence in the ND under shear deformation due to low grain boundary strength. The weakness of grain boundary may be responsible, at least in part, for the spall incurred before penetration and plug failures of over-aged plates. Also, adiabatic heat generated in the shear bands appears to lead to the formation of small precipitates inside of the shear bands.

Example 2

Testing of 2XXX+Li Alloy (AA2099)

AA2099 is prepared for aging, similar to that illustrated in FIG. 2, as a 1" plate. A first sample of AA2099 is aged to peak strength in a T8 temper, having a tensile yield strength (L) of about 71.8 ksi. A second sample of AA2099 produced in a T8 temper, but is underaged, achieving a tensile yield strength (L) of about 64.9 ksi. Both samples are subjected to FSP resistance testing in accordance with MIL-STD-662F(1997) using 0.50 caliber rounds. The second, underaged aluminum alloy realizes a better FSP performance than the peak aged sample. The second, underaged sample realizes a V50 FSP performance of about 3000 feet per second, whereas the first, peak aged sample realizes a V50 FSP performance of about 2950 feet per second.

Example 3

Testing of 2XXX+Li+Ag Alloy

A second alloy, similar to AA2099, but having about 0.5 wt. % silver (referred to in this example as the Al—Li—Ag alloy), is prepared for aging, similar to that illustrated in FIG. 2, as a 1" plate. A first sample of the Al—Li—Ag alloy is aged to peak strength in a T8 temper, having a tensile yield strength (L) of about 83.6 ksi. A second sample of the Al—Li—Ag alloy is produced in a T8 temper, but is underaged, achieving a tensile yield strength (L) of about 75.9 ksi. Both samples are subjected to FSP resistance testing in accordance with MIL-STD-662F(1997) using 20 mm rounds. The second, under-aged aluminum alloy realizes a better FSP performance than the peak aged sample. The second, underaged sample realizes a V50 FSP performance of about 1638 feet per second, whereas the first, peak aged sample realizes a V50 FSP performance of about 1535 feet per second. FSP resistance testing with 50 caliber rounds are also tested. Again, the second, underaged aluminum alloy realizes a better FSP performance than the peak aged sample. The second, underaged sample realizes a V50 FSP performance (50 cal.) of about 3740 feet per second, whereas the first, peak aged sample realizes a V50 FSP performance of about 3550 feet per second. Both samples are also subjected to AP resistance testing. The first, peak aged sample realizes a V50 AP resistance of about 2353 feet per second, and the second, underaged sample realizes a V50 AP resistance of about 2305 feet per second. The increase in FSP resistance is about 6.3% and about 5.1% for 20 mm and 50 caliber rounds, respectively. The decrease in AP resistance is about 2.1%, which is much less than the FSP resistance increase. The FSP resistance for 20 mm increased at about 3× the rate of AP resistance decrease. In other words, the AP decrease is 33.3% of the FSP increase relative to 20 mm FSP. The FSP resistance for 50 caliber rounds increased at about 2.4× the rate of AP resistance decrease. In other words, the AP decrease is about 41.2% of the FSP increase relative to 50 caliber FSP.

What is claimed is:

1. A method comprising:

selecting ballistics performance criteria for an aluminum alloy product, wherein the aluminum alloy product is an armor component for one of an armored vehicle and personal armor; and producing the aluminum alloy product, wherein the aluminum alloy product realizes a ballistics performance that is at least as good as the ballistics performance criteria, and wherein the producing step comprises:

preparing the aluminum alloy product for aging; and aging the aluminum alloy product, wherein the aging step comprises underaging the aluminum alloy product an amount sufficient to achieve the ballistics performance, wherein the ballistics performance is better than that of a peak strength aged version of the aluminum alloy product.

2. The method of claim 1, wherein the ballistics performance criteria comprises FSP resistance criteria, wherein the aging comprises underaging the aluminum alloy product to at least 1% less than peak strength.

3. The method of claim 2, wherein the FSP resistance criteria comprises a minimum V50 performance level, and wherein the minimum V50 performance level is at least 1% better than the minimum V50 performance level of the peak strength aged version of the aluminum alloy product.

4. The method of claim 2, wherein the ballistics performance criteria comprises AP resistance criteria, and wherein the aging comprises underaging the aluminum alloy product an amount such that the ballistics performance of the aluminum alloy product achieves both the FSP resistance criteria and the AP resistance criteria.

5. The method of claim 4, wherein the ballistics performance comprises FSP resistance and AP resistance, wherein the FSP resistance is at least 1% better than that of the peak strength aged version of the aluminum alloy product, and wherein the AP resistance is at least as good as that of the peak strength aged version of the aluminum alloy product.

6. The method of claim 2, wherein the aging comprises underaging the aluminum alloy product to at least 5% less than peak strength.

7. The method of claim 2, wherein the aging comprises underaging the aluminum alloy product to at least 10% less than peak strength.

8. The method of claim 2, wherein the aging comprises underaging the aluminum alloy product to at least 25% less than peak strength.

9. The method of claim 7, wherein the aging consists of naturally aging.

10. The method of claim 7, wherein the aging comprises artificially aging.

11. The method of claim 1, wherein the aluminum alloy product comprises one of a 2XXX or 7XXX aluminum alloy.

12. The method of claim 11, wherein the aluminum alloy product comprises a 2XXX aluminum alloy.

13. The method of claim 12, wherein the aluminum alloy product comprises up to 2.6 wt. % Li and up to 1.0 wt. % Ag.

14. The method of claim 13, wherein the aging comprises at least one of naturally aging and artificially aging.

15. The method of claim 11, wherein the aluminum alloy product comprises a 7XXX aluminum alloy.

16. The method of claim 15, wherein the aging comprises at least one of naturally aging and artificially aging.

* * * * *